US008944767B2

(12) United States Patent
Stoicescu et al.

(10) Patent No.: US 8,944,767 B2
(45) Date of Patent: Feb. 3, 2015

(54) FUEL SYSTEM CENTRIFUGAL BOOST PUMP IMPELLER

(75) Inventors: Adrian L. Stoicescu, Roscoe, IL (US); Steven A. Heitz, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 587 days.

(21) Appl. No.: 13/351,900

(22) Filed: Jan. 17, 2012

(65) Prior Publication Data

US 2013/0183155 A1 Jul. 18, 2013

(51) Int. Cl.

| | |
|---|---|
| ***F04D 13/12*** | (2006.01) |
| ***F04D 1/02*** | (2006.01) |
| ***F04D 29/22*** | (2006.01) |
| ***F04D 9/04*** | (2006.01) |

(52) U.S. Cl.

CPC ..... *F04D 1/025* (2013.01); *F04D 29/2216* (2013.01); *F04D 9/04* (2013.01)

USPC ..... 416/175; 416/176; 416/177; 416/198 R

(58) Field of Classification Search

CPC ..... F04D 1/025; F04D 1/08; F04D 9/04; F04D 17/025; F04D 29/2216; F04D 29/242

USPC ..... 416/175, 176, 177, 198 R, 203; 415/72

See application file for complete search history.

(56) References Cited

U.S. PATENT DOCUMENTS

| | | | | |
|---|---|---|---|---|
| 3,163,119 | A * | 12/1964 | Hupper et al. | 415/72 |
| 4,142,839 | A * | 3/1979 | Davis et al. | 417/89 |
| 4,687,412 | A | 8/1987 | Chamberlain | |
| 5,100,295 | A * | 3/1992 | Madden | 416/175 |
| 5,152,661 | A | 10/1992 | Sheets | |
| 5,527,149 | A | 6/1996 | Moss et al. | |
| 6,422,808 | B1 | 7/2002 | Moss et al. | |
| 6,551,054 | B1 * | 4/2003 | Peltonen et al. | 415/72 |
| 6,632,071 | B2 | 10/2003 | Pauly | |
| 6,935,840 | B2 | 8/2005 | Romani et al. | |
| 7,070,388 | B2 | 7/2006 | Meng et al. | |
| 7,189,056 | B2 | 3/2007 | Girgis et al. | |
| 7,201,565 | B2 * | 4/2007 | Ku et al. | 416/175 |
| 7,273,352 | B2 * | 9/2007 | Williams et al. | 416/175 |
| 7,293,958 | B2 | 11/2007 | Kraffzik | |
| 7,455,497 | B2 * | 11/2008 | Lee | 415/72 |
| 7,572,105 | B2 | 8/2009 | Columbus et al. | |

* cited by examiner

*Primary Examiner* — Nathaniel Wiehe
*Assistant Examiner* — Adam W Brown
(74) *Attorney, Agent, or Firm* — Carlson, Gaskey & Olds, P.C.

(57) ABSTRACT

A centrifugal boost pump inducer section includes a plurality of inducer main blades, and a plurality of splitter blades, each of which includes normal to the blade mean line cross sectional surfaces distributed over the length of the blades, the cross sectional surfaces defined as a set of R-coordinates, theta-coordinates and Z-coordinates relative to an impeller outer diameter set out in one set of tables. A centrifugal boost pump impeller section includes a plurality of impeller main blades, a plurality of primary splitter blades, and a plurality of secondary splitter blades, each of which includes normal to the blade mean line cross sectional surfaces distributed over the length of the blades, the cross sectional surfaces defined as a set of R-coordinates, theta-coordinates and Z-coordinates relative to an impeller outer diameter set out in another set of tables.

6 Claims, 4 Drawing Sheets

FUEL SYSTEM CENTRIFUGAL BOOST PUMP IMPELLER

BACKGROUND

This disclosure relates to an aircraft jet engine mounted centrifugal fuel boost pump, for example, in particular to the impeller blades.

The boost pump is commonly packaged together with the main fuel pump, which is usually of a positive displacement gear pump type, both being driven by a common shaft. The fuel leaving the boost stage goes through a filter and a fuel oil heat exchanger before entering the main pump. Pressure losses are introduced by these components and the associated plumbing, while heat is also added to the fuel. The fuel feeding the boost pump comes from the main frame fuel tanks through the main frame plumbing. The tanks are usually vented to the ambient atmospheric pressure, or, in some cases, are pressurized a couple of psi above that. The tanks are provided with immersed pumping devices, which are in some cases axial flow pumps driven by electric motors or turbines, or in other cases ejector pumps, collectively referred to as main frame boost pumps.

During flight, the pressure in the tank decreases with altitude following the natural depression in the ambient atmospheric pressure. Under normal operating conditions, industry standards require the main frame boost pumps to provide uninterrupted flow to the engine mounted boost pumps at a minimum of 5 psi above the true vapor pressure of the fuel and with no V/L (vapor liquid ratio) or no vapor present as a secondary phase. Under abnormal operation, which amounts to inoperable main frame boost pumps, the pressure at the inlet of the boost stage pumps can be only 2, or 3 psi above the fuel true vapor pressure, while vapor can be present up to a V/L ratio of 0.45, or more. Definition of terms, recommended testing practices, and fuel physical characteristics are outlined in industry specifications and standards like Coordinating Research Council Report 635, AIR 1326, SAE ARP 492, SAE ARP 4024, ASTM D 2779, and ASTM D 3827, for example.

During normal or abnormal operation, the boost pump is required to maintain enough pressure at the main pump inlet under all the operating conditions encountered in a full flight mission such as the main pump can maintain the demanded output flow and pressure to the fuel control and metering unit for continuous and uninterrupted engine operation. There are also limitations in the maximum pressure rise the engine mounted boost pump is allowed to deliver such not to exceed the mechanical pressure rating of the fuel oil heat exchanger, or limitations pertaining to minimum impeller blade spacing such as a large contaminant like a bolt lost from maintenance interventions would pass through and be trapped safely in the downstream filter. All these requirements along with satisfying a full flow operating range from large flows during takeoff to a trickle of flow during flight idle descent, and fuel temperature swings from −40 F to 300 F, makes the aerodynamic design of the engine mounted fuel pumps a serious challenge.

In order to achieve the pressure rise demanded by the downstream main fuel pump and fuel metering system and to also be capable of operating with extreme low suction conditions encountered during the abnormal operation, the boost pump impellers are provided with a radial blade section and with an axial blade section upstream there from. The radial blade section is commonly referred to as the impeller blade section, while the axial blade section is referred to as the inducer blade section. The inducer's primary function is to sustain good pressure and flow conditions at the inlet of the impeller radial section even under the low suction conditions imposed by the abnormal operation, where the main frame boost pumps are inoperable.

The gap between the minimum required supply pressure for normal engine operation and the maximum allowed discharge pressure demanded by pressure rating limitations of the inter-stage fuel oil heat exchanger are often so narrow, that the final design is determined only after the first unit went through design and development testing. The impeller diameter, which primarily controls the pump pressure rise, is intentionally set to a slightly larger value in the initial design, the unit built and tested, and ultimately the impeller diameter is trimmed to its final value such to match all the constraints imposed by the requirements.

SUMMARY

A disclosed boost pump inducer section includes a plurality of main blades, and a plurality of splitter blades, that each includes normal to the blade mean line cross sectional surfaces distributed over the length of the blades. The cross sectional surfaces are defined as a set of cylindrical R-coordinates, theta-coordinates and Z-coordinates relative to an impeller outer diameter set out in one set of tables, TABLE N-1, and TABLE N-2, where N is the same value.

A disclosed boost pump impeller section includes a plurality of main blades, a plurality of primary splitter blades, and a plurality of secondary splitter blades, that each includes normal to the blade mean line cross sectional surfaces distributed over the length of the blades. The cross sectional surfaces are defined as a set of cylindrical R-coordinates, theta-coordinates and Z-coordinates relative to an impeller outer diameter set out in one set of tables, TABLE N-3, TABLE N-4, and TABLE N-5, where N is the same value.

BRIEF DESCRIPTION OF THE DRAWINGS

The disclosure can be further understood by reference to the following detailed description when considered in connection with the accompanying drawings wherein.

DETAILED DESCRIPTION

Figure 1:
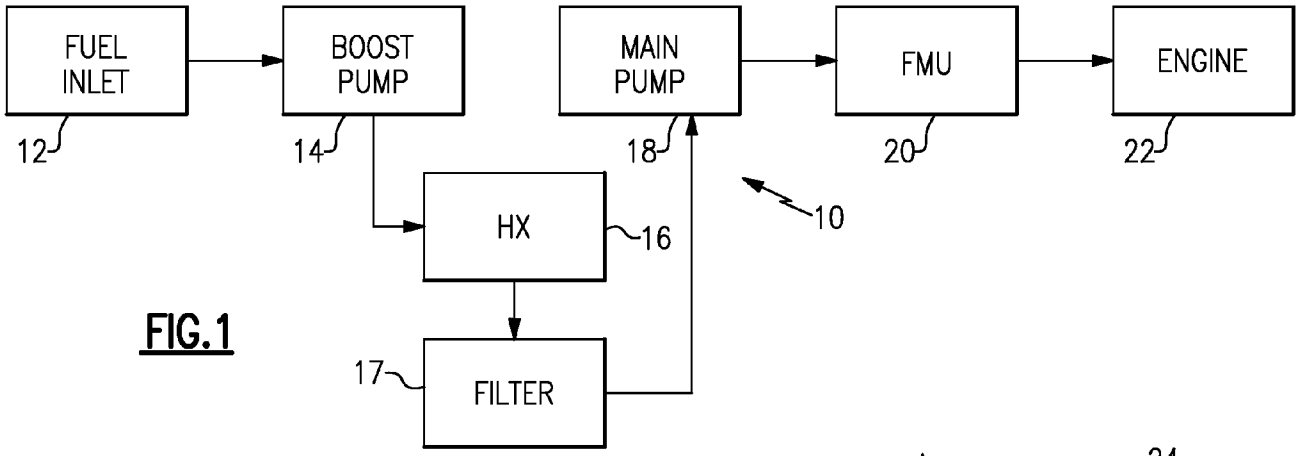
FIG. 1 is a schematic of an example fuel delivery system.

A schematic of an example of engine mounted fuel delivery system, for example, for an aircraft, is illustrated in FIG. 1. The system 10 includes a fuel inlet 12 that is fluidly connected to airframe plumbing at engine airframe interface. Fuel is delivered to this interface from the aircraft fuel tanks by means of airframe mounted fuel pumps. A boost pump 14 pressurizes the fuel before providing the fuel to the main pump 18. Typically, a filter 17 and a heat exchanger 16 are installed in between the boost pump 14 and the main pump 18. Fuel from the main pump 18 is regulated by a fuel metering unit 20, which supplies pressure regulated fuel to the engine 22.

Figure 2:
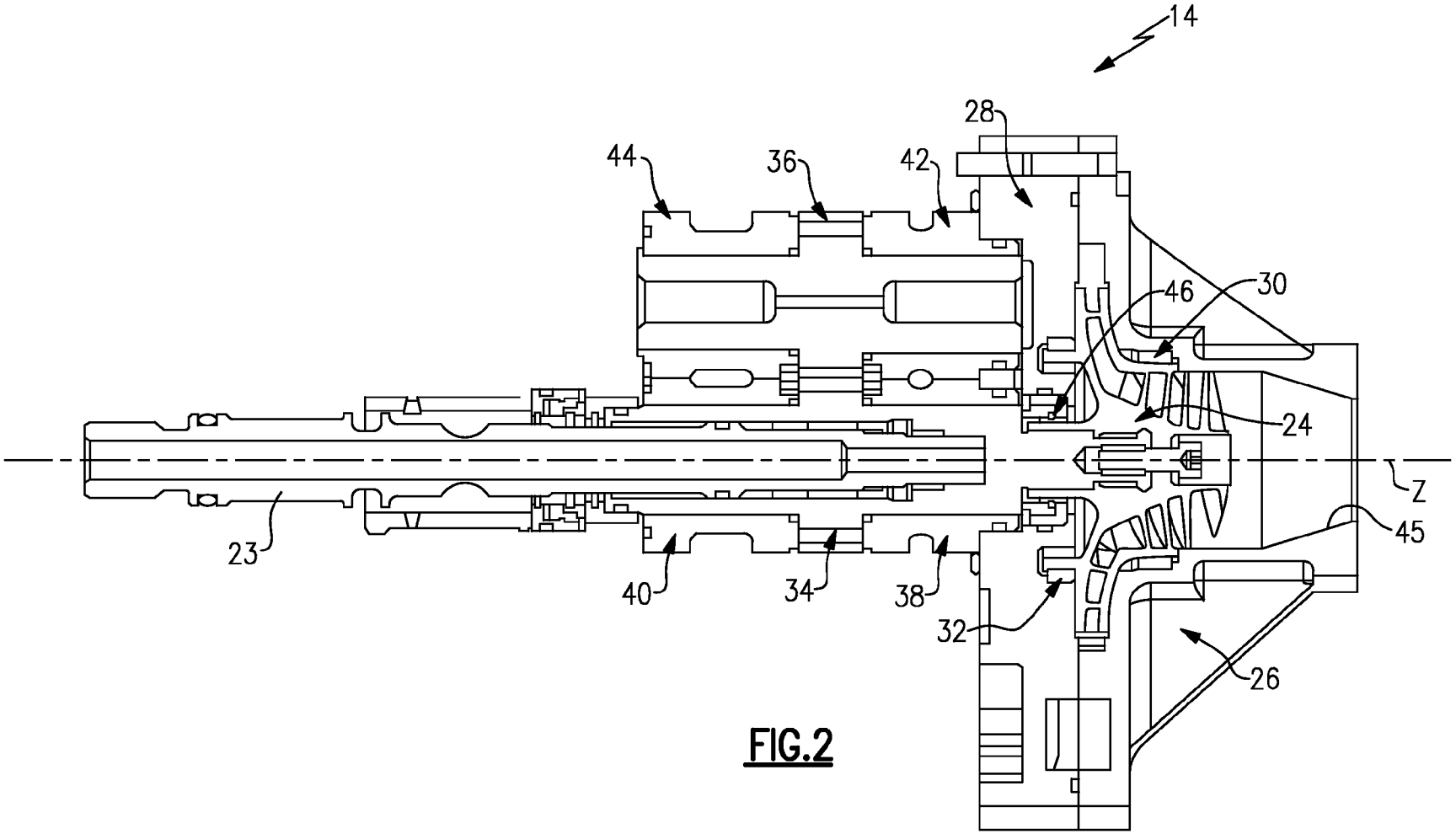
FIG. 2 is a cross-sectional view of the engine mounted boost pump.
Figure 6:
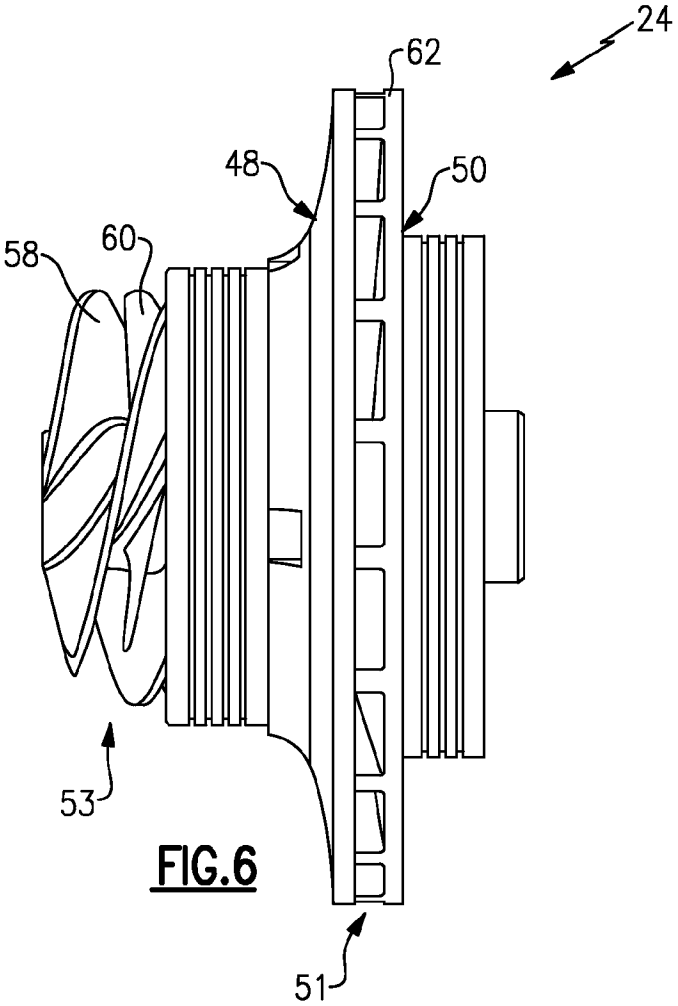
FIG. 6 is a side view of the boost stage impeller.
Figure 5:
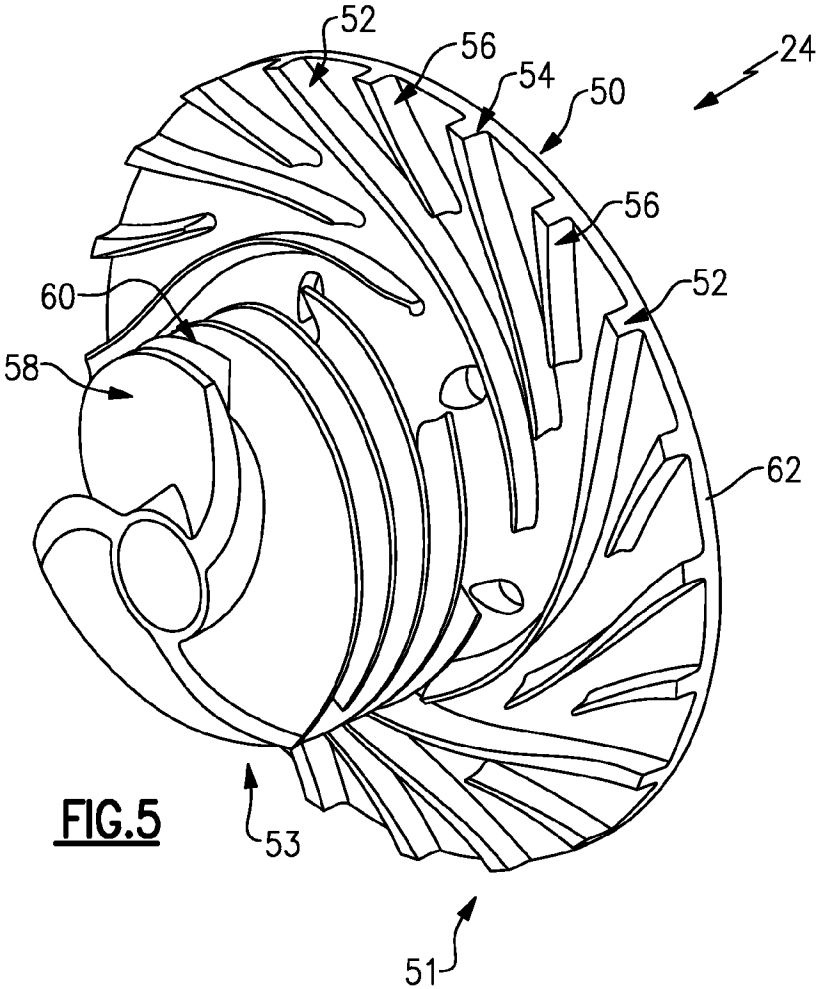
FIG. 5 is a perspective view of the boost stage impeller with front shroud removed.

FIG. 2 shows a cross-sectional view of an example engine-mounted boost and main fuel pump having the longitudinal axis, which corresponds to an axis Z. Only the boost pump 14 is illustrated in FIG. 2. The boost pump 14 includes a shrouded impeller 24 rotationally driven by a shaft 23, which is typically driven by a gearbox mounted on the engine. The impeller 24 is arranged between a boost housing cover 26 and a center plate 28. Front and rear labyrinth seals 30, 32 respectively seal between the impeller 24 and the boost housing cover 26 and center plate 28. A rear side face seal 46 is also provided between the center plate 28 and the impeller 24 in the example shown.

The shaft 23 is splined to a drive gear 34, which is couple to and rotationally drives a driven gear 36. A drive gear floating bearing 38 and a drive gear fixed bearing 40 support the drive gear 34. A driven gear floating bearing 42 and a driven gear fixed bearing 44 support the driven gear 36.

During operation, fuel flow enters through the inlet from the far right side opening 45 of the boost pump housing cover 26 flowing axially from left to right. The fuel flow then enters first the inducer section 53 of the rotating impeller 24 where the pressure is raised and the eventual air and vapor phase present in the mixture are compressed back in to solution such by the time the fuel flow reaches the impeller section 51 most of the mixture is in the liquid phase. The fuel flow then enters the impeller section 51 where the majority of the pressure rise takes place, while the fluid absolute velocity is greatly increased. The fuel flow leaves the impeller 24 at its outside diameter exit port, or perimeter 62, under significantly larger pressure and with large velocity in an almost tangential direction. At this location, the flow stream contains potential energy based on the actual static pressure and a good amount of kinetic energy due to the high flow velocity.

FIGS. 3-6 show various views of the impeller 24, which is cast or machined. Typically, machined impellers are provided by two components in the example, a hub 50 and a shroud 48. The inducer and impeller blades are machined directly in the hub as one piece. The shroud 48 is machined separately and attached by brazing to the hub 50. In case the impeller 24 is mounted on the drive shaft by means of a thread, the shroud 48 is provided with a couple of notches as a wrenching feature.

The impeller section 51 has three sets of blades, a set of main blades 52, a set of primary splitter blades 54, and a set of secondary splitter blades 56. In one example, there are five main blades 52, five primary splitter blades 54, and ten secondary splitter blades 56. The outer ends of these blades are evenly circumferentially spaced from one another at the perimeter 62, in the example.

Figure 4:
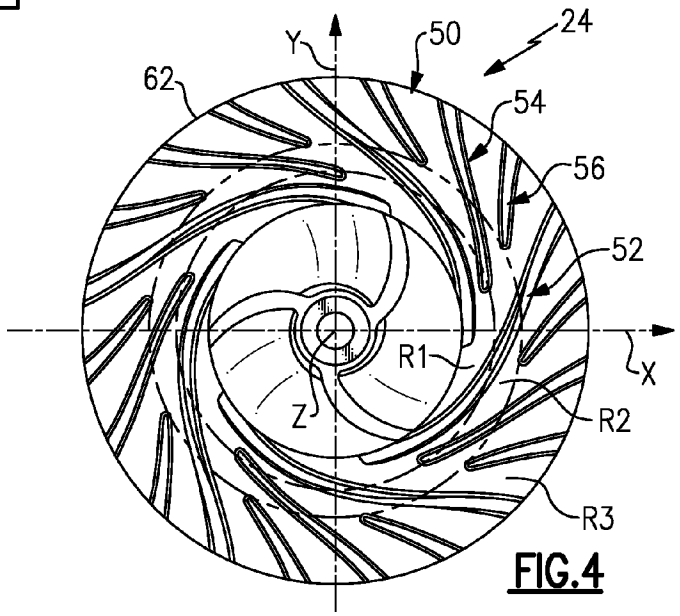
FIG. 4 is a front view of the boost stage impeller with front shroud removed.
Figure 3:
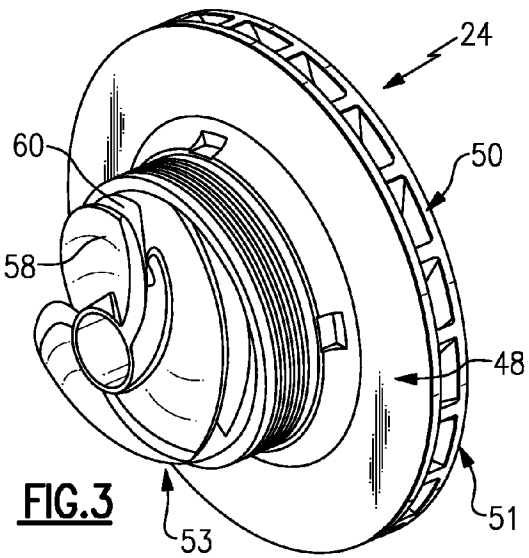
FIG. 3 is a perspective view of the boost stage impeller.

A typical impeller blade works by engaging the incoming flow at the leading edge of the blade with some incidence and by guiding the flow along its length all the way to impeller exit port at the perimeter 62 efficiently and without generating eddies or flow separation. The fluid stream is forced by the cascade of blades into a complex rotational motion combined with a longitudinal and radial motion. The inertial effects of the centrifugal and Coriolis forces introduced by the forced fluid motion impart pressure into the fluid. The impeller section 51 achieves the desired fluid characteristics, in part, by the geometry of the three regions, R1, R2, R3 as shown in FIG. 4, where R1 is provided circumferentially between the main blades 52 upstream from the primary splitter blades 54, R2 is provided circumferentially between the main blades 52 and the primary splitter blades 54, and R3 is provided circumferentially between the primary splitter blades 54 and the secondary splitter blades 56. The blade surface running against the fluid develops higher pressures at the pressure side, while on the opposite side of the blade a depression is created on the suction side. The blade shape and length impart the required amount of work into the fluid with minimum viscous drag and without introducing eddies, or flow separation.

The inducer section 53 has two sets of blades, a set of inducer main blades 58, and a set of inducer splitter blades 60. The inducer section 53 is axial as opposed to mostly radial, as in the impeller section 51. The fluid stream guidance and energy transfer mechanism between the inducer section blades and the fluid are similar to those encountered in the impeller section 51, except for the fact that the calculations are based on a two phase mixture. The mixture contains a liquid phase and a gaseous phase, where the gaseous phase contains air and vapor of the fuel. Staring from the opening 45, the pressure is progressively rising due to the work imposed by the inducer section blades, and consequently the vapor and air present in the gaseous phase are compressed back into solution. The hub shape in the inducer section is designed to provide larger volume towards inlet where the specific volume of the two-phase mixture is the smallest.

Figure 8:
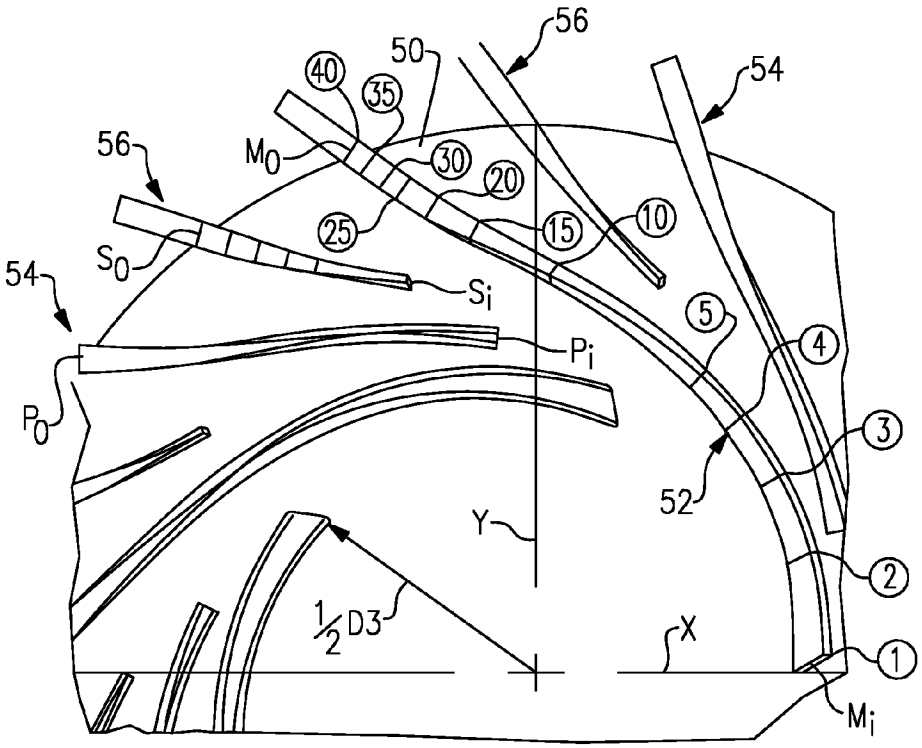
FIG. 8 is a front view of the impeller blades showing geometry defining cross sections.
Figure 7:
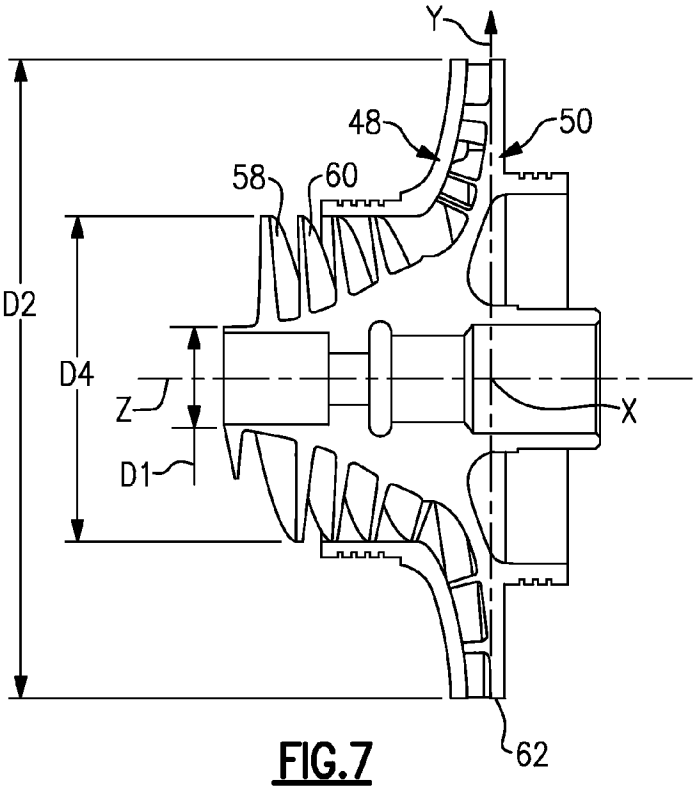
FIG. 7 is a side cross-sectional view of the boost stage impeller.

Referring to FIG. 7, the first inducer main blade 58 begins at an inner diameter D1 and extends radially outwardly to an outer diameter D4. The impeller main blade 52 begins at an inner diameter D3, as shown in FIG. 8, and extends radially outwardly to an outer diameter D2, which corresponds to the perimeter 62. In one example, D4 and D3 are approximately equal to one another.

FIG. 8 shows a front view of the impeller blades along with the cross section defining the blade geometry. The blade thickness varies along the blade as well as from hub to shroud in a linear progression. As a result, each cross section has a rectangular shape and is defined by means of numerical coordinates of the four corner points, as explained below with reference to FIG. 9. Generally, sections through each blade correspond to the "station numbers" located at a particular angle "theta," referred to in the Tables. The stations for the impeller main blade 52 for the data in Table 1-3 are shown in FIG. 8. The first set of data corresponds to section Mi and continues to the last set of data, Mo, for the impeller main blade 52. Similarly, the first set of data corresponds to section Pi and continues to the last set of data, Po, for the primary splitter blade 54; the first set of data corresponds to section Si and continues to the last set of data, So, for the secondary splitter blade 56. A various number of sections may be used to define a given blade, as is evident by the data in the Tables.

The coordinates of all the cross sections used to generate the geometry of the blades are listed in a cylindrical coordinate system, which lines up with the impeller and pump axis. The four corner points of each cross section are the hub pressure side, hub suction side, shroud pressure side, and shroud suction side based on their physical location. The final shape of the blade is obtained by cubic spline interpolation between the corresponding points of all the cross section composing a blade. The blade coordinate tables defining the inducer blades and the impeller blades are listed under TABLE N-1 through N-5, where N represents a value and the same values represent a set of data for a given impeller 24. That is, Tables 1-1, 1-2, 1-3, 1-4, 1-5 represent data for one example impeller; Tables 2-1, 2-2, 2-3, 2-4, 2-5 represent data for another example impeller; Tables 3-1, 3-2, 3-3, 3-4, 3-5 represent data for yet another example impeller.

Figure 9:
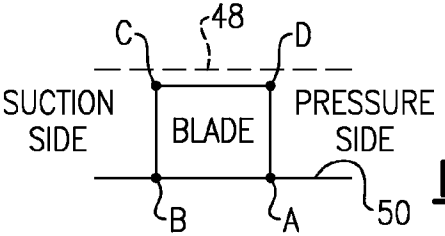
FIG. 9 is a cross-sectional view through a blade, which illustrates the coordinate system of the disclosure.

Tables N-1 through N-5 defining the inducer and impeller blade geometries are shown in a cylindrical coordinate system for R, theta, and Z, in inches, of each blade surface. Tables N-1 is a cylindrical coordinate table defining the inducer main blade 58 geometry. Tables N-2 is a cylindrical coordinate table defining the inducer splitter blade 60 geometry. Tables N-3 is a cylindrical coordinate table defining the impeller main blade 52 geometry. Tables N-4 is a cylindrical coordinate table defining the impeller primary splitter blade 54 geometry. Tables N-5 is a cylindrical coordinate table defining the impeller secondary splitter blade 56 geometry. Referring to FIG. 9 with reference to the Tables, the "shroud pressure side" corresponds to point A, the "shroud suction side" corresponds to point B, the "hub suction side" corresponds to point C, and the "hub pressure side" corresponds to point D. Together points A-D define a quadrilateral cross-section through the respective blade.

The cylindrical coordinate system Z axis aligns with the impeller 24 axis of rotation, with the Z zero coordinate in the axial plane corresponding with where the main, primary splitter and secondary splitter impeller blades 52, 54, 56 intersect the perimeter 62. The positive direction of the Z axis points towards the pump opening 45. The R coordinate corresponds to the distance from the Z axis, and theta is the relative angular position. One example impeller 24 includes diameters as follows: D1≈0.5 in (12.7 mm), D3≈D4≈2.0 in (50.8 mm), D2≈4.0 in (101.6 mm). The data in the Tables corresponds to a ratio between the given R and Z coordinate and the impeller outer diameter D2.

The Table values are shown to four decimal places. However, in view of manufacturing constraints, actual values useful for manufacture of the component are considered to be the values to determine the claimed profile. There are typical manufacturing tolerances, which must be accounted for in the profile. Accordingly, the Table coordinate values are for nominal component. It will therefore be appreciated that plus or minus typical manufacturing tolerances are applicable to the Table coordinate values and that a component having a profile substantially in accordance with those values includes tolerances. For example, a manufacturing tolerance of about +/−0.010 inches on surface profile should be considered within the design limits for the component. Thus, the mechanical and aerodynamic functions of the component are not impaired by manufacturing imperfections and tolerances, which in different embodiments may be greater or lesser than the values set forth in the disclosed Tables. As appreciated by those skilled in the art, manufacturing tolerances may be determined to achieve a desired mean and standard deviation of manufactured components in relation to the ideal component profile points set forth in the disclosed Tables.

TABLE 1-1

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0.2533 | 359.8734 | 0.4428 | 0.2533 | 0.1266 | 0.4481 | 0.0800 | 357.7933 | 0.4408 | 0.0800 | 2.2067 | 0.4504 |
| 2 | 0.2533 | 0.4115 | 0.4422 | 0.2533 | 0.6773 | 0.4478 | 0.0800 | 358.1998 | 0.4400 | 0.0800 | 2.8889 | 0.4501 |
| 3 | 0.2533 | 1.6917 | 0.4409 | 0.2533 | 1.9702 | 0.4468 | 0.0800 | 359.3485 | 0.4384 | 0.0800 | 4.3135 | 0.4492 |
| 4 | 0.2533 | 3.5770 | 0.4391 | 0.2533 | 3.8681 | 0.4452 | 0.0800 | 1.1022 | 0.4363 | 0.0800 | 6.3430 | 0.4477 |
| 5 | 0.2533 | 6.0068 | 0.4367 | 0.2533 | 6.3105 | 0.4431 | 0.0800 | 3.4003 | 0.4337 | 0.0800 | 8.9170 | 0.4456 |
| 6 | 0.2533 | 8.9425 | 0.4339 | 0.2533 | 9.2590 | 0.4406 | 0.0800 | 6.2045 | 0.4306 | 0.0800 | 11.9970 | 0.4431 |
| 7 | 0.2533 | 12.3566 | 0.4307 | 0.2533 | 12.6857 | 0.4377 | 0.0800 | 9.4870 | 0.4270 | 0.0800 | 15.5553 | 0.4401 |
| 8 | 0.2533 | 16.2275 | 0.4271 | 0.2533 | 16.5693 | 0.4343 | 0.0800 | 13.2263 | 0.4229 | 0.0800 | 19.5705 | 0.4367 |
| 9 | 0.2533 | 20.5379 | 0.4231 | 0.2533 | 20.8923 | 0.4305 | 0.0800 | 17.4051 | 0.4185 | 0.0800 | 24.0251 | 0.4328 |
| 10 | 0.2533 | 25.2733 | 0.4187 | 0.2533 | 25.6403 | 0.4264 | 0.0800 | 22.0095 | 0.4136 | 0.0800 | 28.9042 | 0.4286 |
| 11 | 0.2533 | 30.4213 | 0.4139 | 0.2533 | 30.8010 | 0.4219 | 0.0801 | 27.0303 | 0.4084 | 0.0799 | 34.1921 | 0.4239 |
| 12 | 0.2533 | 35.9712 | 0.4088 | 0.2533 | 36.3636 | 0.4170 | 0.0803 | 32.4588 | 0.4028 | 0.0799 | 39.8760 | 0.4189 |
| 13 | 0.2533 | 41.9135 | 0.4033 | 0.2533 | 42.3185 | 0.4118 | 0.0805 | 38.2873 | 0.3967 | 0.0799 | 45.9447 | 0.4135 |
| 14 | 0.2533 | 48.2397 | 0.3975 | 0.2533 | 48.6574 | 0.4062 | 0.0809 | 44.5091 | 0.3904 | 0.0800 | 52.3880 | 0.4077 |
| 15 | 0.2533 | 54.9422 | 0.3913 | 0.2533 | 55.3726 | 0.4003 | 0.0814 | 51.1186 | 0.3836 | 0.0802 | 59.1962 | 0.4015 |
| 16 | 0.2533 | 62.0142 | 0.3848 | 0.2533 | 62.4572 | 0.3941 | 0.0820 | 58.2426 | 0.3768 | 0.0805 | 66.2287 | 0.3947 |
| 17 | 0.2533 | 69.4492 | 0.3779 | 0.2533 | 69.9049 | 0.3875 | 0.0827 | 65.7406 | 0.3696 | 0.0809 | 73.6135 | 0.3876 |
| 18 | 0.2533 | 77.2415 | 0.3708 | 0.2533 | 77.7098 | 0.3806 | 0.0836 | 73.6075 | 0.3621 | 0.0815 | 81.3439 | 0.3801 |
| 19 | 0.2533 | 85.3857 | 0.3633 | 0.2533 | 85.8667 | 0.3734 | 0.0847 | 81.8382 | 0.3543 | 0.0823 | 89.4142 | 0.3723 |
| 20 | 0.2533 | 93.8831 | 0.3557 | 0.2533 | 94.3641 | 0.3657 | 0.0860 | 90.4281 | 0.3461 | 0.0832 | 97.8192 | 0.3641 |
| 21 | 0.2533 | 102.7228 | 0.3477 | 0.2533 | 103.2037 | 0.3578 | 0.0875 | 99.3724 | 0.3376 | 0.0844 | 106.5541 | 0.3556 |
| 22 | 0.2533 | 111.9003 | 0.3395 | 0.2533 | 112.3813 | 0.3495 | 0.0893 | 108.6665 | 0.3288 | 0.0857 | 115.6151 | 0.3468 |
| 23 | 0.2533 | 121.4116 | 0.3309 | 0.2533 | 121.8926 | 0.3409 | 0.0913 | 118.3054 | 0.3197 | 0.0873 | 124.9987 | 0.3377 |
| 24 | 0.2533 | 131.2521 | 0.3221 | 0.2533 | 131.7335 | 0.3320 | 0.0936 | 128.2820 | 0.3102 | 0.0892 | 134.7036 | 0.3283 |
| 25 | 0.2533 | 141.4088 | 0.3129 | 0.2533 | 141.8912 | 0.3229 | 0.0962 | 138.5814 | 0.3004 | 0.0913 | 144.7187 | 0.3185 |
| 26 | 0.2533 | 151.8641 | 0.3035 | 0.2533 | 152.3482 | 0.3134 | 0.0991 | 149.1846 | 0.2904 | 0.0938 | 155.0277 | 0.3084 |
| 27 | 0.2533 | 162.5981 | 0.2938 | 0.2533 | 163.0847 | 0.3036 | 0.1024 | 160.0706 | 0.2800 | 0.0966 | 165.6122 | 0.2980 |
| 28 | 0.2533 | 173.5888 | 0.2837 | 0.2533 | 174.0785 | 0.2936 | 0.1060 | 171.3005 | 0.2696 | 0.0999 | 176.3668 | 0.2870 |
| 29 | 0.2533 | 184.8120 | 0.2735 | 0.2533 | 185.3058 | 0.2832 | 0.1100 | 182.7541 | 0.2590 | 0.1036 | 187.3636 | 0.2756 |
| 30 | 0.2533 | 196.2416 | 0.2629 | 0.2533 | 196.7403 | 0.2726 | 0.1144 | 194.4041 | 0.2480 | 0.1078 | 198.5778 | 0.2640 |
| 31 | 0.2533 | 207.8496 | 0.2520 | 0.2533 | 208.3542 | 0.2617 | 0.1193 | 206.2213 | 0.2368 | 0.1125 | 209.9824 | 0.2521 |
| 32 | 0.2533 | 219.6064 | 0.2409 | 0.2533 | 220.1179 | 0.2505 | 0.1247 | 218.1756 | 0.2253 | 0.1177 | 221.5486 | 0.2398 |
| 33 | 0.2533 | 231.4812 | 0.2295 | 0.2533 | 232.0006 | 0.2391 | 0.1307 | 230.2356 | 0.2135 | 0.1235 | 233.2461 | 0.2273 |
| 34 | 0.2533 | 243.4420 | 0.2179 | 0.2533 | 243.9705 | 0.2273 | 0.1373 | 242.3692 | 0.2014 | 0.1299 | 245.0433 | 0.2145 |
| 35 | 0.2533 | 255.4564 | 0.2060 | 0.2533 | 255.9952 | 0.2153 | 0.1445 | 254.5435 | 0.1890 | 0.1371 | 256.9081 | 0.2014 |
| 36 | 0.2533 | 267.4916 | 0.1938 | 0.2533 | 268.0420 | 0.2032 | 0.1520 | 266.7225 | 0.1761 | 0.1452 | 268.8111 | 0.1882 |
| 37 | 0.2533 | 279.5151 | 0.1813 | 0.2533 | 280.0783 | 0.1908 | 0.1591 | 278.8669 | 0.1630 | 0.1530 | 280.7265 | 0.1747 |
| 38 | 0.2533 | 291.4947 | 0.1686 | 0.2533 | 292.0721 | 0.1781 | 0.1658 | 290.9487 | 0.1495 | 0.1604 | 292.6181 | 0.1609 |
| 39 | 0.2533 | 303.3993 | 0.1556 | 0.2533 | 303.9925 | 0.1652 | 0.1721 | 302.9412 | 0.1359 | 0.1673 | 304.4505 | 0.1469 |
| 40 | 0.2533 | 315.1990 | 0.1424 | 0.2533 | 315.8094 | 0.1520 | 0.1779 | 314.8178 | 0.1220 | 0.1738 | 316.1906 | 0.1325 |
| 41 | 0.2533 | 326.8655 | 0.1289 | 0.2533 | 327.4948 | 0.1386 | 0.1833 | 326.5526 | 0.1078 | 0.1797 | 327.8077 | 0.1178 |
| 42 | 0.2533 | 338.3724 | 0.1151 | 0.2533 | 339.0220 | 0.1251 | 0.1851 | 338.1115 | 0.0934 | 0.1882 | 339.2829 | 0.1028 |

TABLE 1-2

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 | 0 |
| 10 | 0 | 0 | 0 | 0 | 0 | 0 | 0 | 0 | 0 | 0 | 0 | 0 |
| 11 | 0 | 0 | 0 | 0 | 0 | 0 | 0 | 0 | 0 | 0 | 0 | 0 |
| 12 | 0 | 0 | 0 | 0 | 0 | 0 | 0 | 0 | 0 | 0 | 0 | 0 |
| 13 | 0 | 0 | 0 | 0 | 0 | 0 | 0 | 0 | 0 | 0 | 0 | 0 |
| 14 | 0 | 0 | 0 | 0 | 0 | 0 | 0 | 0 | 0 | 0 | 0 | 0 |
| 15 | 0 | 0 | 0 | 0 | 0 | 0 | 0 | 0 | 0 | 0 | 0 | 0 |
| 16 | 0 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 | 0 |
| 18 | 0 | 0 | 0 | 0 | 0 | 0 | 0 | 0 | 0 | 0 | 0 | 0 |
| 19 | 0 | 0 | 0 | 0 | 0 | 0 | 0 | 0 | 0 | 0 | 0 | 0 |
| 20 | 0 | 0 | 0 | 0 | 0 | 0 | 0 | 0 | 0 | 0 | 0 | 0 |
| 21 | 0 | 0 | 0 | 0 | 0 | 0 | 0 | 0 | 0 | 0 | 0 | 0 |
| 22 | 0 | 0 | 0 | 0 | 0 | 0 | 0 | 0 | 0 | 0 | 0 | 0 |
| 23 | 0 | 0 | 0 | 0 | 0 | 0 | 0 | 0 | 0 | 0 | 0 | 0 |
| 24 | 0 | 0 | 0 | 0 | 0 | 0 | 0 | 0 | 0 | 0 | 0 | 0 |
| 25 | 0.2533 | 81.5294 | 0.3155 | 0.2533 | 81.7706 | 0.3205 | 0.0950 | 80.0962 | 0.3049 | 0.0926 | 83.2039 | 0.3140 |
| 26 | 0.2533 | 91.9741 | 0.3059 | 0.2533 | 92.2382 | 0.3113 | 0.0979 | 90.4930 | 0.2945 | 0.0950 | 93.7193 | 0.3043 |
| 27 | 0.2533 | 102.6976 | 0.2959 | 0.2533 | 102.9851 | 0.3017 | 0.1012 | 101.1850 | 0.2837 | 0.0978 | 104.4978 | 0.2943 |
| 28 | 0.2533 | 113.6778 | 0.2856 | 0.2533 | 113.9895 | 0.2919 | 0.1050 | 112.1496 | 0.2726 | 0.1010 | 115.5177 | 0.2840 |
| 29 | 0.2533 | 124.8905 | 0.2751 | 0.2533 | 125.2272 | 0.2818 | 0.1091 | 123.3620 | 0.2612 | 0.1045 | 126.7557 | 0.2734 |
| 30 | 0.2533 | 136.3096 | 0.2643 | 0.2533 | 136.6723 | 0.2714 | 0.1138 | 134.7952 | 0.2496 | 0.1084 | 138.1867 | 0.2625 |
| 31 | 0.2533 | 147.9069 | 0.2532 | 0.2533 | 148.2968 | 0.2607 | 0.1189 | 146.4199 | 0.2376 | 0.1128 | 149.7838 | 0.2512 |
| 32 | 0.2533 | 159.6529 | 0.2419 | 0.2533 | 160.0714 | 0.2497 | 0.1247 | 158.2054 | 0.2254 | 0.1177 | 161.5188 | 0.2397 |
| 33 | 0.2533 | 171.5166 | 0.2302 | 0.2533 | 171.9652 | 0.2385 | 0.1310 | 170.1195 | 0.2129 | 0.1232 | 173.3623 | 0.2279 |
| 34 | 0.2533 | 183.4660 | 0.2184 | 0.2533 | 183.9465 | 0.2269 | 0.1380 | 182.1287 | 0.2002 | 0.1292 | 185.2838 | 0.2157 |
| 35 | 0.2533 | 195.4686 | 0.2062 | 0.2533 | 195.9830 | 0.2151 | 0.1456 | 194.1987 | 0.1871 | 0.1360 | 197.2529 | 0.2033 |
| 36 | 0.2533 | 207.4916 | 0.1938 | 0.2533 | 208.0420 | 0.2032 | 0.1534 | 206.2891 | 0.1735 | 0.1437 | 209.2445 | 0.1908 |
| 37 | 0.2533 | 219.5151 | 0.1813 | 0.2533 | 220.0783 | 0.1908 | 0.1606 | 218.4152 | 0.1600 | 0.1515 | 221.1781 | 0.1777 |
| 38 | 0.2533 | 231.4947 | 0.1686 | 0.2533 | 232.0721 | 0.1781 | 0.1674 | 230.4778 | 0.1462 | 0.1588 | 233.0890 | 0.1642 |
| 39 | 0.2533 | 243.3993 | 0.1556 | 0.2533 | 243.9925 | 0.1652 | 0.1737 | 242.4496 | 0.1322 | 0.1657 | 244.9421 | 0.1505 |
| 40 | 0.2533 | 255.1990 | 0.1424 | 0.2533 | 255.8094 | 0.1520 | 0.1795 | 254.3035 | 0.1179 | 0.1722 | 256.7049 | 0.1365 |
| 41 | 0.2533 | 266.8655 | 0.1289 | 0.2533 | 267.4948 | 0.1386 | 0.1848 | 266.0133 | 0.1034 | 0.1782 | 268.3470 | 0.1222 |
| 42 | 0.2533 | 278.3724 | 0.1151 | 0.2533 | 279.0220 | 0.1251 | 0.1835 | 277.5157 | 0.0886 | 0.1898 | 279.8787 | 0.1076 |

TABLE 1-3

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0.2730 | 3.3293 | 0.0893 | 0.2689 | 3.4785 | 0.0926 | 0.2381 | 0.1147 | 0.0407 | 0.2427 | 359.8853 | 0.0382 |
| 2 | 0.2842 | 23.4282 | 0.0823 | 0.2790 | 23.6557 | 0.0857 | 0.2542 | 23.3564 | 0.0337 | 0.2599 | 23.0351 | 0.0314 |
| 3 | 0.2967 | 38.7517 | 0.0758 | 0.2904 | 39.0586 | 0.0792 | 0.2701 | 39.6599 | 0.0282 | 0.2768 | 39.2531 | 0.0260 |
| 4 | 0.3097 | 50.8733 | 0.0701 | 0.3024 | 51.2633 | 0.0734 | 0.2855 | 52.0260 | 0.0237 | 0.2931 | 51.5331 | 0.0216 |
| 5 | 0.3226 | 60.5236 | 0.0651 | 0.3144 | 61.0005 | 0.0684 | 0.3001 | 61.6608 | 0.0201 | 0.3086 | 61.0803 | 0.0181 |
| 6 | 0.3353 | 68.2458 | 0.0608 | 0.3261 | 68.8132 | 0.0641 | 0.3139 | 69.2954 | 0.0172 | 0.3232 | 68.6250 | 0.0153 |
| 7 | 0.3473 | 74.4624 | 0.0572 | 0.3373 | 75.1239 | 0.0604 | 0.3267 | 75.4253 | 0.0147 | 0.3368 | 74.6629 | 0.0129 |
| 8 | 0.3587 | 79.5017 | 0.0541 | 0.3479 | 80.2610 | 0.0572 | 0.3386 | 80.4045 | 0.0127 | 0.3495 | 79.5474 | 0.0110 |
| 9 | 0.3694 | 83.6171 | 0.0515 | 0.3578 | 84.4777 | 0.0545 | 0.3496 | 84.4925 | 0.0111 | 0.3612 | 83.5379 | 0.0094 |
| 10 | 0.3795 | 87.0035 | 0.0493 | 0.3671 | 87.9689 | 0.0522 | 0.3598 | 87.8825 | 0.0096 | 0.3721 | 86.8280 | 0.0080 |
| 11 | 0.3888 | 89.8109 | 0.0474 | 0.3758 | 90.8846 | 0.0502 | 0.3692 | 90.7207 | 0.0084 | 0.3822 | 89.5635 | 0.0069 |
| 12 | 0.3976 | 92.1550 | 0.0457 | 0.3839 | 93.3403 | 0.0485 | 0.3779 | 93.1184 | 0.0074 | 0.3915 | 91.8559 | 0.0060 |
| 13 | 0.4057 | 94.1256 | 0.0443 | 0.3914 | 95.4256 | 0.0470 | 0.3861 | 95.1611 | 0.0066 | 0.4002 | 93.7909 | 0.0052 |
| 14 | 0.4133 | 95.7927 | 0.0431 | 0.3985 | 97.2104 | 0.0457 | 0.3936 | 96.9155 | 0.0058 | 0.4083 | 95.4351 | 0.0045 |
| 15 | 0.4205 | 97.2113 | 0.0421 | 0.4051 | 98.7495 | 0.0445 | 0.4007 | 98.4336 | 0.0052 | 0.4158 | 96.8410 | 0.0039 |
| 16 | 0.4272 | 98.4248 | 0.0412 | 0.4114 | 100.0862 | 0.0435 | 0.4073 | 99.7568 | 0.0046 | 0.4229 | 98.0497 | 0.0034 |
| 17 | 0.4335 | 99.4680 | 0.0404 | 0.4173 | 101.2548 | 0.0426 | 0.4135 | 100.9176 | 0.0041 | 0.4295 | 99.0942 | 0.0029 |
| 18 | 0.4394 | 100.3686 | 0.0397 | 0.4229 | 102.2830 | 0.0418 | 0.4194 | 101.9426 | 0.0037 | 0.4357 | 100.0011 | 0.0026 |
| 19 | 0.4450 | 101.1492 | 0.0392 | 0.4282 | 103.1930 | 0.0411 | 0.4250 | 102.8528 | 0.0033 | 0.4416 | 100.7917 | 0.0022 |
| 20 | 0.4503 | 101.8279 | 0.0386 | 0.4332 | 104.0028 | 0.0405 | 0.4303 | 103.6657 | 0.0029 | 0.4472 | 101.4835 | 0.0019 |
| 21 | 0.4550 | 102.4723 | 0.0382 | 0.4383 | 104.6714 | 0.0399 | 0.4356 | 104.3510 | 0.0026 | 0.4521 | 102.1354 | 0.0017 |
| 22 | 0.4595 | 103.0528 | 0.0379 | 0.4432 | 105.2754 | 0.0394 | 0.4407 | 104.9544 | 0.0023 | 0.4568 | 102.7251 | 0.0015 |
| 23 | 0.4638 | 103.5787 | 0.0376 | 0.4478 | 105.8221 | 0.0389 | 0.4455 | 105.5028 | 0.0020 | 0.4614 | 103.2643 | 0.0013 |
| 24 | 0.4680 | 104.0580 | 0.0373 | 0.4523 | 106.3191 | 0.0385 | 0.4502 | 106.0060 | 0.0018 | 0.4657 | 103.7607 | 0.0011 |
| 25 | 0.4719 | 104.4975 | 0.0370 | 0.4566 | 106.7734 | 0.0382 | 0.4546 | 106.4703 | 0.0016 | 0.4699 | 104.2201 | 0.0010 |
| 26 | 0.4758 | 104.9030 | 0.0368 | 0.4608 | 107.1906 | 0.0378 | 0.4589 | 106.9012 | 0.0014 | 0.4740 | 104.6479 | 0.0008 |

TABLE 1-3-continued

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 27 | 0.4795 | 105.2796 | 0.0367 | 0.4648 | 107.5760 | 0.0376 | 0.4630 | 107.3030 | 0.0012 | 0.4779 | 105.0481 | 0.0007 |
| 28 | 0.4831 | 105.6315 | 0.0365 | 0.4686 | 107.9338 | 0.0373 | 0.4670 | 107.6795 | 0.0011 | 0.4817 | 105.4246 | 0.0006 |
| 29 | 0.4867 | 105.9625 | 0.0364 | 0.4724 | 108.2678 | 0.0371 | 0.4709 | 108.0340 | 0.0009 | 0.4854 | 105.7805 | 0.0005 |
| 30 | 0.4901 | 106.2757 | 0.0363 | 0.4760 | 108.5815 | 0.0369 | 0.4746 | 108.3693 | 0.0008 | 0.4890 | 106.1185 | 0.0004 |
| 31 | 0.4935 | 106.5740 | 0.0362 | 0.4796 | 108.8777 | 0.0367 | 0.4783 | 108.6880 | 0.0007 | 0.4925 | 106.4412 | 0.0003 |
| 32 | 0.4968 | 106.8599 | 0.0361 | 0.4830 | 109.1589 | 0.0366 | 0.4819 | 108.9921 | 0.0006 | 0.4960 | 106.7507 | 0.0002 |
| 33 | 0.5001 | 107.1356 | 0.0360 | 0.4864 | 109.4275 | 0.0364 | 0.4854 | 109.2837 | 0.0005 | 0.4994 | 107.0489 | 0.0002 |
| 34 | 0.5033 | 107.4032 | 0.0360 | 0.4897 | 109.6856 | 0.0363 | 0.4888 | 109.5645 | 0.0004 | 0.5028 | 107.3376 | 0.0001 |
| 35 | 0.5065 | 107.6644 | 0.0360 | 0.4930 | 109.9349 | 0.0362 | 0.4922 | 109.8363 | 0.0003 | 0.5061 | 107.6184 | 0.0000 |
| 36 | 0.5097 | 107.9209 | 0.0360 | 0.4961 | 110.1772 | 0.0361 | 0.4956 | 110.1004 | 0.0002 | 0.5094 | 107.8928 | 0.0000 |
| 37 | 0.5128 | 108.1740 | 0.0360 | 0.4993 | 110.4137 | 0.0361 | 0.4989 | 110.3586 | 0.0002 | 0.5126 | 108.1625 | 0.0000 |
| 38 | 0.5160 | 108.4229 | 0.0360 | 0.5023 | 110.6437 | 0.0360 | 0.5022 | 110.6146 | 0.0001 | 0.5159 | 108.4312 | 0.0000 |
| 39 | 0.5192 | 108.6846 | 0.0360 | 0.5055 | 110.8835 | 0.0360 | 0.5053 | 110.8543 | 0.0001 | 0.5191 | 108.6842 | −0.0001 |
| 40 | 0.5859 | 113.2560 | 0.0360 | 0.5721 | 115.2092 | 0.0360 | 0.5720 | 115.2348 | 0.0001 | 0.5857 | 113.3040 | −0.0001 |

TABLE 1-4

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0.3209 | 96.6227 | 0.0658 | 0.3162 | 96.8973 | 0.0677 | 0.3019 | 97.5387 | 0.0197 | 0.3068 | 97.2025 | 0.0186 |
| 6 | 0.3334 | 104.3594 | 0.0615 | 0.3280 | 104.6945 | 0.0634 | 0.3158 | 105.1593 | 0.0168 | 0.3213 | 104.7611 | 0.0157 |
| 7 | 0.3453 | 110.5907 | 0.0578 | 0.3393 | 110.9895 | 0.0598 | 0.3287 | 111.2753 | 0.0144 | 0.3348 | 110.8129 | 0.0133 |
| 8 | 0.3566 | 115.6450 | 0.0547 | 0.3500 | 116.1105 | 0.0566 | 0.3407 | 116.2403 | 0.0124 | 0.3474 | 115.7116 | 0.0113 |
| 9 | 0.3672 | 119.7756 | 0.0521 | 0.3600 | 120.3108 | 0.0539 | 0.3518 | 120.3138 | 0.0107 | 0.3590 | 119.7166 | 0.0097 |
| 10 | 0.3772 | 123.1776 | 0.0498 | 0.3694 | 123.7852 | 0.0517 | 0.3620 | 123.6892 | 0.0093 | 0.3698 | 123.0213 | 0.0083 |
| 11 | 0.3864 | 126.0009 | 0.0479 | 0.3781 | 126.6837 | 0.0497 | 0.3716 | 126.5124 | 0.0082 | 0.3798 | 125.7718 | 0.0072 |
| 12 | 0.3951 | 128.3612 | 0.0462 | 0.3863 | 129.1218 | 0.0480 | 0.3804 | 128.8948 | 0.0072 | 0.3891 | 128.0795 | 0.0062 |
| 13 | 0.4032 | 130.3484 | 0.0448 | 0.3939 | 131.1892 | 0.0465 | 0.3886 | 130.9220 | 0.0063 | 0.3977 | 130.0300 | 0.0054 |
| 14 | 0.4108 | 132.0324 | 0.0436 | 0.4011 | 132.9558 | 0.0452 | 0.3962 | 132.6605 | 0.0056 | 0.4057 | 131.6901 | 0.0047 |
| 15 | 0.4178 | 133.4681 | 0.0425 | 0.4078 | 134.4763 | 0.0441 | 0.4033 | 134.1626 | 0.0049 | 0.4132 | 133.1120 | 0.0041 |
| 16 | 0.4245 | 134.6992 | 0.0416 | 0.4141 | 135.7941 | 0.0431 | 0.4100 | 135.4694 | 0.0044 | 0.4202 | 134.3370 | 0.0036 |
| 17 | 0.4307 | 135.7601 | 0.0408 | 0.4200 | 136.9437 | 0.0423 | 0.4162 | 136.6138 | 0.0039 | 0.4268 | 135.3980 | 0.0031 |
| 18 | 0.4366 | 136.6786 | 0.0401 | 0.4256 | 137.9526 | 0.0415 | 0.4221 | 137.6220 | 0.0035 | 0.4330 | 136.3216 | 0.0027 |
| 19 | 0.4422 | 137.4773 | 0.0395 | 0.4309 | 138.8431 | 0.0408 | 0.4277 | 138.5154 | 0.0031 | 0.4388 | 137.1291 | 0.0024 |
| 20 | 0.4475 | 138.1743 | 0.0390 | 0.4360 | 139.6333 | 0.0402 | 0.4330 | 139.3113 | 0.0028 | 0.4444 | 137.8380 | 0.0021 |
| 21 | 0.4525 | 138.7909 | 0.0385 | 0.4408 | 140.3319 | 0.0397 | 0.4381 | 140.0238 | 0.0025 | 0.4496 | 138.4626 | 0.0018 |
| 22 | 0.4573 | 139.3428 | 0.0381 | 0.4454 | 140.9667 | 0.0392 | 0.4429 | 140.6582 | 0.0022 | 0.4547 | 139.0213 | 0.0016 |
| 23 | 0.4619 | 139.8390 | 0.0377 | 0.4498 | 141.5453 | 0.0388 | 0.4474 | 141.2385 | 0.0020 | 0.4595 | 139.5287 | 0.0014 |
| 24 | 0.4663 | 140.2876 | 0.0374 | 0.4540 | 142.0751 | 0.0384 | 0.4518 | 141.7740 | 0.0017 | 0.4641 | 139.9926 | 0.0012 |
| 25 | 0.4706 | 140.6957 | 0.0371 | 0.4580 | 142.5629 | 0.0381 | 0.4560 | 142.2711 | 0.0015 | 0.4686 | 140.4194 | 0.0010 |
| 26 | 0.4747 | 141.0691 | 0.0369 | 0.4619 | 143.0144 | 0.0378 | 0.4600 | 142.7350 | 0.0014 | 0.4729 | 140.8141 | 0.0009 |
| 27 | 0.4786 | 141.4130 | 0.0367 | 0.4657 | 143.4345 | 0.0375 | 0.4639 | 143.1699 | 0.0012 | 0.4770 | 141.1812 | 0.0007 |
| 28 | 0.4825 | 141.7318 | 0.0365 | 0.4693 | 143.8274 | 0.0373 | 0.4677 | 143.5797 | 0.0011 | 0.4810 | 141.5244 | 0.0006 |
| 29 | 0.4862 | 142.0295 | 0.0364 | 0.4728 | 144.1969 | 0.0371 | 0.4713 | 143.9675 | 0.0009 | 0.4850 | 141.8469 | 0.0005 |
| 30 | 0.4899 | 142.3092 | 0.0363 | 0.4763 | 144.5460 | 0.0369 | 0.4749 | 144.3361 | 0.0008 | 0.4888 | 142.1517 | 0.0004 |
| 31 | 0.4935 | 142.5740 | 0.0362 | 0.4796 | 144.8777 | 0.0367 | 0.4783 | 144.6880 | 0.0007 | 0.4925 | 142.4412 | 0.0003 |
| 32 | 0.4968 | 142.8599 | 0.0361 | 0.4830 | 145.1589 | 0.0366 | 0.4819 | 144.9921 | 0.0006 | 0.4960 | 142.7507 | 0.0002 |
| 33 | 0.5001 | 143.1356 | 0.0360 | 0.4864 | 145.4275 | 0.0364 | 0.4854 | 145.2837 | 0.0005 | 0.4994 | 143.0489 | 0.0002 |
| 34 | 0.5033 | 143.4032 | 0.0360 | 0.4897 | 145.6856 | 0.0363 | 0.4888 | 145.5645 | 0.0004 | 0.5028 | 143.3376 | 0.0001 |
| 35 | 0.5065 | 143.6644 | 0.0360 | 0.4930 | 145.9349 | 0.0362 | 0.4922 | 145.8363 | 0.0003 | 0.5061 | 143.6184 | 0.0000 |
| 36 | 0.5097 | 143.9209 | 0.0360 | 0.4961 | 146.1772 | 0.0361 | 0.4956 | 146.1004 | 0.0002 | 0.5094 | 143.8928 | 0.0000 |
| 37 | 0.5128 | 144.1740 | 0.0360 | 0.4993 | 146.4137 | 0.0361 | 0.4989 | 146.3586 | 0.0002 | 0.5126 | 144.1625 | 0.0000 |
| 38 | 0.5160 | 144.4229 | 0.0360 | 0.5023 | 146.6437 | 0.0360 | 0.5022 | 146.6146 | 0.0001 | 0.5159 | 144.4312 | 0.0000 |
| 39 | 0.5192 | 144.6846 | 0.0360 | 0.5055 | 146.8835 | 0.0360 | 0.5053 | 146.8543 | 0.0001 | 0.5191 | 144.6842 | −0.0001 |
| 40 | 0.5859 | 149.2560 | 0.0360 | 0.5721 | 151.2092 | 0.0360 | 0.5720 | 151.2348 | 0.0001 | 0.5857 | 149.3040 | −0.0001 |

TABLE 1-5

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |

TABLE 1-5-continued

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 7 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 | 0 |
| 10 | 0 | 0 | 0 | 0 | 0 | 0 | 0 | 0 | 0 | 0 | 0 | 0 |
| 11 | 0.3846 | 108.1508 | 0.0483 | 0.3800 | 108.5285 | 0.0493 | 0.3734 | 108.3480 | 0.0079 | 0.3780 | 107.9363 | 0.0074 |
| 12 | 0.3933 | 110.5118 | 0.0466 | 0.3881 | 110.9657 | 0.0476 | 0.3821 | 110.7315 | 0.0070 | 0.3873 | 110.2427 | 0.0064 |
| 13 | 0.4015 | 112.4991 | 0.0451 | 0.3956 | 113.0327 | 0.0462 | 0.3902 | 112.7602 | 0.0061 | 0.3960 | 112.1917 | 0.0056 |
| 14 | 0.4091 | 114.1826 | 0.0438 | 0.4027 | 114.7994 | 0.0450 | 0.3978 | 114.5007 | 0.0054 | 0.4041 | 113.8499 | 0.0048 |
| 15 | 0.4163 | 115.6175 | 0.0428 | 0.4093 | 116.3206 | 0.0439 | 0.4048 | 116.0050 | 0.0048 | 0.4117 | 115.2696 | 0.0042 |
| 16 | 0.4230 | 116.8472 | 0.0418 | 0.4155 | 117.6396 | 0.0429 | 0.4114 | 117.3144 | 0.0043 | 0.4188 | 116.4920 | 0.0037 |
| 17 | 0.4294 | 117.9063 | 0.0410 | 0.4214 | 118.7908 | 0.0421 | 0.4176 | 118.4616 | 0.0038 | 0.4255 | 117.5502 | 0.0032 |
| 18 | 0.4354 | 118.8227 | 0.0403 | 0.4269 | 119.8018 | 0.0413 | 0.4234 | 119.4730 | 0.0034 | 0.4318 | 118.4706 | 0.0028 |
| 19 | 0.4410 | 119.6188 | 0.0396 | 0.4321 | 120.6948 | 0.0407 | 0.4289 | 120.3698 | 0.0030 | 0.4377 | 119.2746 | 0.0025 |
| 20 | 0.4464 | 120.3130 | 0.0391 | 0.4371 | 121.4880 | 0.0401 | 0.4342 | 121.1694 | 0.0027 | 0.4433 | 119.9798 | 0.0022 |
| 21 | 0.4515 | 120.9252 | 0.0386 | 0.4418 | 122.1911 | 0.0396 | 0.4391 | 121.8859 | 0.0024 | 0.4486 | 120.6004 | 0.0019 |
| 22 | 0.4563 | 121.4725 | 0.0382 | 0.4464 | 122.8305 | 0.0391 | 0.4438 | 122.5256 | 0.0021 | 0.4537 | 121.1539 | 0.0016 |
| 23 | 0.4610 | 121.9640 | 0.0378 | 0.4507 | 123.4140 | 0.0387 | 0.4483 | 123.1116 | 0.0019 | 0.4586 | 121.6556 | 0.0014 |
| 24 | 0.4655 | 122.4075 | 0.0375 | 0.4548 | 123.9490 | 0.0383 | 0.4526 | 123.6529 | 0.0017 | 0.4633 | 122.1138 | 0.0012 |
| 25 | 0.4698 | 122.8103 | 0.0372 | 0.4588 | 124.4423 | 0.0380 | 0.4568 | 124.1559 | 0.0015 | 0.4678 | 122.5346 | 0.0010 |
| 26 | 0.4739 | 123.1782 | 0.0370 | 0.4626 | 124.8995 | 0.0377 | 0.4607 | 124.6257 | 0.0013 | 0.4721 | 122.9233 | 0.0009 |
| 27 | 0.4780 | 123.5164 | 0.0368 | 0.4663 | 125.3255 | 0.0375 | 0.4646 | 125.0668 | 0.0012 | 0.4763 | 123.2843 | 0.0007 |
| 28 | 0.4819 | 123.8294 | 0.0366 | 0.4699 | 125.7246 | 0.0372 | 0.4683 | 125.4827 | 0.0010 | 0.4804 | 123.6214 | 0.0006 |
| 29 | 0.4857 | 124.1210 | 0.0364 | 0.4734 | 126.1003 | 0.0370 | 0.4719 | 125.8767 | 0.0009 | 0.4844 | 123.9378 | 0.0005 |
| 30 | 0.4894 | 124.3946 | 0.0363 | 0.4768 | 126.4558 | 0.0368 | 0.4754 | 126.2515 | 0.0008 | 0.4883 | 124.2363 | 0.0004 |
| 31 | 0.4930 | 124.6532 | 0.0362 | 0.4801 | 126.7939 | 0.0367 | 0.4788 | 126.6096 | 0.0007 | 0.4920 | 124.5196 | 0.0003 |
| 32 | 0.4966 | 124.8994 | 0.0361 | 0.4833 | 127.1171 | 0.0365 | 0.4821 | 126.9530 | 0.0006 | 0.4958 | 124.7898 | 0.0002 |
| 33 | 0.5001 | 125.1356 | 0.0360 | 0.4864 | 127.4275 | 0.0364 | 0.4854 | 127.2837 | 0.0005 | 0.4994 | 125.0489 | 0.0002 |
| 34 | 0.5033 | 125.4032 | 0.0360 | 0.4897 | 127.6856 | 0.0363 | 0.4888 | 127.5645 | 0.0004 | 0.5028 | 125.3376 | 0.0001 |
| 35 | 0.5065 | 125.6644 | 0.0360 | 0.4930 | 127.9349 | 0.0362 | 0.4922 | 127.8363 | 0.0003 | 0.5061 | 125.6184 | 0.0000 |
| 36 | 0.5097 | 125.9209 | 0.0360 | 0.4961 | 128.1772 | 0.0361 | 0.4956 | 128.1004 | 0.0002 | 0.5094 | 125.8928 | 0.0000 |
| 37 | 0.5128 | 126.1740 | 0.0360 | 0.4993 | 128.4137 | 0.0361 | 0.4989 | 128.3586 | 0.0002 | 0.5126 | 126.1625 | 0.0000 |
| 38 | 0.5160 | 126.4229 | 0.0360 | 0.5023 | 128.6437 | 0.0360 | 0.5022 | 128.6146 | 0.0001 | 0.5159 | 126.4312 | 0.0000 |
| 39 | 0.5192 | 126.6846 | 0.0360 | 0.5055 | 128.8835 | 0.0360 | 0.5053 | 128.8543 | 0.0001 | 0.5191 | 126.6842 | −0.0001 |
| 40 | 0.5859 | 131.2560 | 0.0360 | 0.5721 | 133.2092 | 0.0360 | 0.5720 | 133.2348 | 0.0001 | 0.5857 | 131.3040 | −0.0001 |

TABLE 2-1

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0.2055 | 0.0843 | 0.4103 | 0.2055 | 359.9157 | 0.4132 | 0.0828 | 1.0335 | 0.4088 | 0.0828 | 358.9665 | 0.4147 |
| 2 | 0.2055 | 358.9462 | 0.4093 | 0.2055 | 358.7622 | 0.4125 | 0.0828 | 0.0600 | 0.4074 | 0.0828 | 357.6485 | 0.4143 |
| 3 | 0.2055 | 356.2457 | 0.4072 | 0.2055 | 356.0464 | 0.4106 | 0.0828 | 357.5240 | 0.4048 | 0.0828 | 354.7680 | 0.4127 |
| 4 | 0.2055 | 352.2718 | 0.4042 | 0.2055 | 352.0571 | 0.4078 | 0.0828 | 353.7147 | 0.4013 | 0.0828 | 350.6142 | 0.4101 |
| 5 | 0.2055 | 347.1518 | 0.4003 | 0.2055 | 346.9218 | 0.4042 | 0.0828 | 348.7593 | 0.3968 | 0.0828 | 345.3143 | 0.4066 |
| 6 | 0.2055 | 340.9667 | 0.3956 | 0.2055 | 340.7214 | 0.3998 | 0.0828 | 342.7388 | 0.3915 | 0.0828 | 338.9493 | 0.4023 |
| 7 | 0.2055 | 333.7748 | 0.3902 | 0.2055 | 333.5142 | 0.3947 | 0.0828 | 335.7115 | 0.3854 | 0.0828 | 331.5775 | 0.3972 |
| 8 | 0.2055 | 325.6214 | 0.3842 | 0.2055 | 325.3454 | 0.3889 | 0.0828 | 327.7227 | 0.3785 | 0.0828 | 323.2441 | 0.3913 |
| 9 | 0.2055 | 316.5429 | 0.3774 | 0.2055 | 316.2516 | 0.3824 | 0.0828 | 318.8087 | 0.3710 | 0.0828 | 313.9857 | 0.3848 |
| 10 | 0.2055 | 306.5698 | 0.3700 | 0.2055 | 306.2632 | 0.3752 | 0.0828 | 309.0003 | 0.3627 | 0.0828 | 303.8328 | 0.3775 |
| 11 | 0.2055 | 295.7283 | 0.3619 | 0.2055 | 295.4063 | 0.3674 | 0.0828 | 298.3233 | 0.3538 | 0.0828 | 292.8113 | 0.3695 |
| 12 | 0.2055 | 284.0408 | 0.3532 | 0.2055 | 283.7035 | 0.3590 | 0.0828 | 286.7987 | 0.3442 | 0.0827 | 280.9455 | 0.3609 |
| 13 | 0.2055 | 271.5274 | 0.3440 | 0.2055 | 271.1747 | 0.3500 | 0.0831 | 274.4387 | 0.3340 | 0.0826 | 268.2633 | 0.3517 |
| 14 | 0.2055 | 258.2058 | 0.3341 | 0.2055 | 257.8378 | 0.3404 | 0.0836 | 261.2515 | 0.3231 | 0.0826 | 254.7921 | 0.3418 |
| 15 | 0.2055 | 244.0921 | 0.3237 | 0.2055 | 243.7088 | 0.3302 | 0.0844 | 247.2472 | 0.3116 | 0.0829 | 240.5536 | 0.3313 |
| 16 | 0.2055 | 229.1932 | 0.3128 | 0.2055 | 228.8099 | 0.3193 | 0.0856 | 232.2739 | 0.3001 | 0.0835 | 225.7292 | 0.3197 |
| 17 | 0.2055 | 213.5300 | 0.3014 | 0.2055 | 213.1467 | 0.3079 | 0.0872 | 216.5126 | 0.2879 | 0.0845 | 210.1641 | 0.3075 |
| 18 | 0.2055 | 197.1151 | 0.2894 | 0.2055 | 196.7314 | 0.2959 | 0.0892 | 199.9783 | 0.2751 | 0.0860 | 193.8681 | 0.2948 |
| 19 | 0.2055 | 179.9793 | 0.2769 | 0.2055 | 179.5921 | 0.2834 | 0.0918 | 182.7195 | 0.2618 | 0.0879 | 176.8518 | 0.2814 |
| 20 | 0.2055 | 162.2877 | 0.2638 | 0.2055 | 161.8928 | 0.2703 | 0.0949 | 164.9055 | 0.2479 | 0.0903 | 159.2751 | 0.2674 |
| 21 | 0.2055 | 144.2586 | 0.2502 | 0.2055 | 143.8514 | 0.2567 | 0.0986 | 146.7551 | 0.2336 | 0.0933 | 141.3549 | 0.2529 |
| 22 | 0.2055 | 126.1312 | 0.2362 | 0.2055 | 125.7067 | 0.2425 | 0.1030 | 128.5077 | 0.2186 | 0.0971 | 123.3301 | 0.2377 |
| 23 | 0.2055 | 108.1500 | 0.2216 | 0.2055 | 107.7027 | 0.2279 | 0.1081 | 110.4091 | 0.2032 | 0.1016 | 105.4436 | 0.2221 |
| 24 | 0.2055 | 90.5481 | 0.2065 | 0.2055 | 90.0720 | 0.2128 | 0.1134 | 92.7068 | 0.1870 | 0.1074 | 87.9133 | 0.2060 |
| 25 | 0.2055 | 73.5325 | 0.1909 | 0.2055 | 73.0210 | 0.1972 | 0.1181 | 75.6342 | 0.1703 | 0.1130 | 70.9193 | 0.1894 |
| 26 | 0.2055 | 57.2735 | 0.1748 | 0.2055 | 56.7200 | 0.1811 | 0.1223 | 59.3601 | 0.1531 | 0.1180 | 54.6333 | 0.1723 |
| 27 | 0.2055 | 41.9003 | 0.1582 | 0.2055 | 41.2974 | 0.1647 | 0.1261 | 44.0047 | 0.1355 | 0.1222 | 39.1929 | 0.1545 |

TABLE 2-2

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 | 0 |
| 10 | 0 | 0 | 0 | 0 | 0 | 0 | 0 | 0 | 0 | 0 | 0 | 0 |
| 11 | 0 | 0 | 0 | 0 | 0 | 0 | 0 | 0 | 0 | 0 | 0 | 0 |
| 12 | 0 | 0 | 0 | 0 | 0 | 0 | 0 | 0 | 0 | 0 | 0 | 0 |
| 13 | 0 | 0 | 0 | 0 | 0 | 0 | 0 | 0 | 0 | 0 | 0 | 0 |
| 14 | 0 | 0 | 0 | 0 | 0 | 0 | 0 | 0 | 0 | 0 | 0 | 0 |
| 15 | 0 | 0 | 0 | 0 | 0 | 0 | 0 | 0 | 0 | 0 | 0 | 0 |
| 16 | 0 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 | 0 |
| 18 | 0 | 0 | 0 | 0 | 0 | 0 | 0 | 0 | 0 | 0 | 0 | 0 |
| 19 | 0 | 0 | 0 | 0 | 0 | 0 | 0 | 0 | 0 | 0 | 0 | 0 |
| 20 | 0 | 0 | 0 | 0 | 0 | 0 | 0 | 0 | 0 | 0 | 0 | 0 |
| 21 | 0 | 0 | 0 | 0 | 0 | 0 | 0 | 0 | 0 | 0 | 0 | 0 |
| 22 | 0.2055 | 186.0038 | 0.2382 | 0.2055 | 185.8340 | 0.2407 | 0.1011 | 186.9075 | 0.2246 | 0.0989 | 184.9303 | 0.2318 |
| 23 | 0.2055 | 168.0494 | 0.2231 | 0.2055 | 167.8033 | 0.2265 | 0.1066 | 169.2641 | 0.2076 | 0.1031 | 166.5886 | 0.2176 |
| 24 | 0.2055 | 150.4767 | 0.2075 | 0.2055 | 150.1434 | 0.2119 | 0.1124 | 151.9714 | 0.1900 | 0.1084 | 148.6487 | 0.2030 |
| 25 | 0.2055 | 133.4941 | 0.1914 | 0.2055 | 133.0594 | 0.1967 | 0.1177 | 135.2726 | 0.1718 | 0.1134 | 131.2809 | 0.1879 |
| 26 | 0.2055 | 117.2735 | 0.1748 | 0.2055 | 116.7200 | 0.1811 | 0.1223 | 119.3601 | 0.1531 | 0.1180 | 114.6333 | 0.1723 |
| 27 | 0.2055 | 101.9003 | 0.1582 | 0.2055 | 101.2974 | 0.1647 | 0.1261 | 104.0047 | 0.1355 | 0.1222 | 99.1929 | 0.1545 |

TABLE 2-3

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0.2261 | 109.6503 | 0.1119 | 0.2224 | 109.3813 | 0.1159 | 0.1808 | 111.7209 | 0.0607 | 0.1853 | 112.2197 | 0.0579 |
| 2 | 0.2348 | 95.1857 | 0.1046 | 0.2303 | 94.8548 | 0.1086 | 0.1952 | 94.7246 | 0.0530 | 0.2004 | 95.2795 | 0.0504 |
| 3 | 0.2447 | 82.1497 | 0.0975 | 0.2394 | 81.7520 | 0.1015 | 0.2096 | 80.6603 | 0.0466 | 0.2155 | 81.2737 | 0.0441 |
| 4 | 0.2553 | 70.7600 | 0.0909 | 0.2493 | 70.2926 | 0.0948 | 0.2238 | 68.9756 | 0.0411 | 0.2303 | 69.6489 | 0.0387 |
| 5 | 0.2664 | 60.9664 | 0.0847 | 0.2596 | 60.4269 | 0.0886 | 0.2377 | 59.2179 | 0.0364 | 0.2448 | 59.9525 | 0.0340 |
| 6 | 0.2777 | 52.6197 | 0.0792 | 0.2703 | 52.0062 | 0.0830 | 0.2511 | 51.0318 | 0.0323 | 0.2588 | 51.8293 | 0.0300 |
| 7 | 0.2889 | 45.5380 | 0.0742 | 0.2809 | 44.8483 | 0.0779 | 0.2641 | 44.1343 | 0.0287 | 0.2724 | 44.9964 | 0.0266 |
| 8 | 0.3000 | 39.5384 | 0.0698 | 0.2914 | 38.7706 | 0.0734 | 0.2766 | 38.2974 | 0.0256 | 0.2853 | 39.2259 | 0.0235 |
| 9 | 0.3108 | 34.4536 | 0.0659 | 0.3016 | 33.6057 | 0.0693 | 0.2884 | 33.3363 | 0.0229 | 0.2977 | 34.3332 | 0.0209 |
| 10 | 0.3212 | 30.1368 | 0.0624 | 0.3116 | 29.2067 | 0.0657 | 0.2998 | 29.1007 | 0.0205 | 0.3094 | 30.1678 | 0.0186 |
| 11 | 0.3313 | 26.4628 | 0.0592 | 0.3211 | 25.4486 | 0.0625 | 0.3105 | 25.4680 | 0.0184 | 0.3206 | 26.6072 | 0.0165 |
| 12 | 0.3409 | 23.3265 | 0.0565 | 0.3304 | 22.2263 | 0.0596 | 0.3207 | 22.3384 | 0.0166 | 0.3312 | 23.5516 | 0.0147 |
| 13 | 0.3501 | 20.6408 | 0.0541 | 0.3392 | 19.4525 | 0.0571 | 0.3305 | 19.6299 | 0.0149 | 0.3413 | 20.9190 | 0.0131 |
| 14 | 0.3589 | 18.3334 | 0.0519 | 0.3477 | 17.0553 | 0.0548 | 0.3397 | 17.2756 | 0.0134 | 0.3508 | 18.6423 | 0.0117 |
| 15 | 0.3673 | 16.3445 | 0.0500 | 0.3558 | 14.9749 | 0.0528 | 0.3484 | 15.2204 | 0.0121 | 0.3599 | 16.6663 | 0.0105 |
| 16 | 0.3754 | 14.6248 | 0.0483 | 0.3635 | 13.1623 | 0.0509 | 0.3568 | 13.4187 | 0.0110 | 0.3685 | 14.9455 | 0.0094 |
| 17 | 0.3830 | 13.1337 | 0.0467 | 0.3709 | 11.5768 | 0.0493 | 0.3647 | 11.8331 | 0.0099 | 0.3767 | 13.4421 | 0.0084 |
| 18 | 0.3903 | 11.8372 | 0.0454 | 0.3781 | 10.1847 | 0.0478 | 0.3723 | 10.4322 | 0.0090 | 0.3844 | 12.1247 | 0.0075 |
| 19 | 0.3973 | 10.7073 | 0.0442 | 0.3849 | 8.9582 | 0.0464 | 0.3795 | 9.1901 | 0.0081 | 0.3918 | 10.9673 | 0.0067 |
| 20 | 0.4040 | 9.7133 | 0.0431 | 0.3914 | 7.8811 | 0.0452 | 0.3865 | 8.0812 | 0.0074 | 0.3988 | 9.9518 | 0.0060 |
| 21 | 0.4104 | 8.8301 | 0.0421 | 0.3977 | 6.9107 | 0.0442 | 0.3931 | 7.1028 | 0.0067 | 0.4056 | 9.0601 | 0.0054 |
| 22 | 0.4165 | 8.0456 | 0.0412 | 0.4037 | 6.0381 | 0.0432 | 0.3995 | 6.2287 | 0.0060 | 0.4120 | 8.2703 | 0.0048 |
| 23 | 0.4221 | 7.3143 | 0.0405 | 0.4098 | 5.2876 | 0.0422 | 0.4058 | 5.4773 | 0.0054 | 0.4180 | 7.5325 | 0.0043 |
| 24 | 0.4276 | 6.6580 | 0.0398 | 0.4156 | 4.6137 | 0.0414 | 0.4119 | 4.8020 | 0.0049 | 0.4237 | 6.8687 | 0.0039 |
| 25 | 0.4328 | 6.0670 | 0.0392 | 0.4212 | 4.0072 | 0.0406 | 0.4178 | 4.1927 | 0.0044 | 0.4292 | 6.2689 | 0.0035 |
| 26 | 0.4379 | 5.5334 | 0.0386 | 0.4266 | 3.4598 | 0.0400 | 0.4235 | 3.6407 | 0.0039 | 0.4345 | 5.7248 | 0.0031 |
| 27 | 0.4428 | 5.0498 | 0.0382 | 0.4319 | 2.9645 | 0.0393 | 0.4289 | 3.1391 | 0.0035 | 0.4397 | 5.2296 | 0.0027 |
| 28 | 0.4475 | 4.6103 | 0.0377 | 0.4370 | 2.5152 | 0.0388 | 0.4342 | 2.6816 | 0.0031 | 0.4446 | 4.7772 | 0.0024 |
| 29 | 0.4521 | 4.2094 | 0.0373 | 0.4419 | 2.1063 | 0.0383 | 0.4394 | 2.2633 | 0.0028 | 0.4494 | 4.3626 | 0.0021 |
| 30 | 0.4565 | 3.8427 | 0.0370 | 0.4468 | 1.7334 | 0.0378 | 0.4444 | 1.8795 | 0.0025 | 0.4541 | 3.9815 | 0.0019 |
| 31 | 0.4609 | 3.5062 | 0.0366 | 0.4514 | 1.3922 | 0.0374 | 0.4492 | 1.5265 | 0.0022 | 0.4587 | 3.6301 | 0.0016 |
| 32 | 0.4651 | 3.1963 | 0.0364 | 0.4560 | 1.0794 | 0.0370 | 0.4540 | 1.2010 | 0.0019 | 0.4631 | 3.3051 | 0.0014 |
| 33 | 0.4693 | 2.9100 | 0.0361 | 0.4605 | 0.7916 | 0.0367 | 0.4586 | 0.9000 | 0.0016 | 0.4674 | 3.0037 | 0.0012 |
| 34 | 0.4733 | 2.6447 | 0.0359 | 0.4648 | 0.5262 | 0.0364 | 0.4631 | 0.6210 | 0.0014 | 0.4717 | 2.7234 | 0.0010 |
| 35 | 0.4773 | 2.3980 | 0.0357 | 0.4691 | 0.2807 | 0.0361 | 0.4675 | 0.3617 | 0.0012 | 0.4758 | 2.4620 | 0.0008 |
| 36 | 0.4812 | 2.1678 | 0.0355 | 0.4733 | 0.0530 | 0.0359 | 0.4719 | 0.1201 | 0.0010 | 0.4799 | 2.2176 | 0.0006 |
| 37 | 0.4850 | 1.9524 | 0.0354 | 0.4773 | 359.8412 | 0.0357 | 0.4761 | 359.8944 | 0.0008 | 0.4839 | 1.9883 | 0.0005 |
| 38 | 0.4888 | 1.7501 | 0.0352 | 0.4814 | 359.6436 | 0.0355 | 0.4803 | 359.6830 | 0.0006 | 0.4878 | 1.7726 | 0.0003 |
| 39 | 0.4925 | 1.5596 | 0.0351 | 0.4853 | 359.4586 | 0.0354 | 0.4845 | 359.4845 | 0.0005 | 0.4917 | 1.5691 | 0.0002 |
| 40 | 0.4961 | 1.3799 | 0.0351 | 0.4892 | 359.2853 | 0.0352 | 0.4886 | 359.2972 | 0.0003 | 0.4956 | 1.3762 | 0.0001 |

TABLE 2-3-continued

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 41 | 0.4997 | 1.2110 | 0.0350 | 0.4930 | 359.1235 | 0.0351 | 0.4927 | 359.1188 | 0.0002 | 0.4995 | 1.1914 | 0.0000 |
| 42 | 0.5037 | 1.0321 | 0.0349 | 0.4971 | 358.9542 | 0.0351 | 0.4963 | 358.9664 | 0.0001 | 0.5029 | 1.0336 | −0.0001 |
| 43 | 0.5726 | 358.3271 | 0.0349 | 0.5660 | 356.5014 | 0.0351 | 0.5653 | 356.4852 | 0.0001 | 0.5719 | 358.3076 | −0.0001 |

TABLE 2-4

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0.2763 | 88.5078 | 0.0799 | 0.2716 | 88.1232 | 0.0823 | 0.2526 | 87.1792 | 0.0319 | 0.2574 | 87.6819 | 0.0305 |
| 7 | 0.2874 | 81.4157 | 0.0749 | 0.2823 | 80.9762 | 0.0772 | 0.2656 | 80.2891 | 0.0284 | 0.2709 | 80.8416 | 0.0270 |
| 8 | 0.2984 | 75.4059 | 0.0704 | 0.2929 | 74.9096 | 0.0727 | 0.2781 | 74.4599 | 0.0253 | 0.2838 | 75.0634 | 0.0239 |
| 9 | 0.3092 | 70.3107 | 0.0665 | 0.3032 | 69.7559 | 0.0687 | 0.2900 | 69.5068 | 0.0226 | 0.2961 | 70.1627 | 0.0212 |
| 10 | 0.3196 | 65.9834 | 0.0629 | 0.3132 | 65.3682 | 0.0651 | 0.3014 | 65.2794 | 0.0202 | 0.3078 | 65.9891 | 0.0189 |
| 11 | 0.3296 | 62.2986 | 0.0598 | 0.3228 | 61.6214 | 0.0620 | 0.3122 | 61.6552 | 0.0181 | 0.3189 | 62.4201 | 0.0168 |
| 12 | 0.3392 | 59.1516 | 0.0570 | 0.3321 | 58.4106 | 0.0591 | 0.3225 | 58.5343 | 0.0163 | 0.3295 | 59.3557 | 0.0150 |
| 13 | 0.3484 | 56.4549 | 0.0545 | 0.3410 | 55.6486 | 0.0566 | 0.3322 | 55.8348 | 0.0146 | 0.3396 | 56.7141 | 0.0134 |
| 14 | 0.3572 | 54.1363 | 0.0524 | 0.3495 | 53.2632 | 0.0543 | 0.3414 | 53.4897 | 0.0132 | 0.3491 | 54.4283 | 0.0120 |
| 15 | 0.3655 | 52.1362 | 0.0504 | 0.3576 | 51.1948 | 0.0523 | 0.3502 | 51.4438 | 0.0119 | 0.3581 | 52.4429 | 0.0108 |
| 16 | 0.3735 | 50.4052 | 0.0487 | 0.3653 | 49.3942 | 0.0505 | 0.3586 | 49.6517 | 0.0107 | 0.3667 | 50.7125 | 0.0096 |
| 17 | 0.3812 | 48.9026 | 0.0471 | 0.3728 | 47.8208 | 0.0489 | 0.3665 | 48.0758 | 0.0097 | 0.3748 | 49.1993 | 0.0086 |
| 18 | 0.3885 | 47.5945 | 0.0457 | 0.3799 | 46.4409 | 0.0474 | 0.3741 | 46.6848 | 0.0088 | 0.3826 | 47.8721 | 0.0078 |
| 19 | 0.3954 | 46.4529 | 0.0445 | 0.3867 | 45.2266 | 0.0461 | 0.3814 | 45.4527 | 0.0079 | 0.3900 | 46.7047 | 0.0070 |
| 20 | 0.4021 | 45.4494 | 0.0434 | 0.3933 | 44.1597 | 0.0449 | 0.3883 | 44.3550 | 0.0072 | 0.3970 | 45.6780 | 0.0062 |
| 21 | 0.4085 | 44.5559 | 0.0424 | 0.3995 | 43.1999 | 0.0439 | 0.3950 | 43.3868 | 0.0065 | 0.4037 | 44.7761 | 0.0056 |
| 22 | 0.4146 | 43.7612 | 0.0415 | 0.4056 | 42.3380 | 0.0429 | 0.4013 | 42.5225 | 0.0058 | 0.4102 | 43.9764 | 0.0050 |
| 23 | 0.4205 | 43.0531 | 0.0407 | 0.4114 | 41.5626 | 0.0420 | 0.4074 | 41.7462 | 0.0053 | 0.4164 | 43.2636 | 0.0045 |
| 24 | 0.4262 | 42.4206 | 0.0400 | 0.4170 | 40.8632 | 0.0412 | 0.4133 | 41.0454 | 0.0048 | 0.4223 | 42.6253 | 0.0040 |
| 25 | 0.4316 | 41.8543 | 0.0393 | 0.4224 | 40.2305 | 0.0405 | 0.4190 | 40.4101 | 0.0043 | 0.4280 | 42.0515 | 0.0036 |
| 26 | 0.4368 | 41.3459 | 0.0388 | 0.4277 | 39.6564 | 0.0398 | 0.4245 | 39.8317 | 0.0038 | 0.4335 | 41.5339 | 0.0032 |
| 27 | 0.4419 | 40.8881 | 0.0382 | 0.4328 | 39.1339 | 0.0392 | 0.4298 | 39.3033 | 0.0035 | 0.4388 | 41.0654 | 0.0028 |
| 28 | 0.4468 | 40.4747 | 0.0378 | 0.4377 | 38.6568 | 0.0387 | 0.4349 | 38.8188 | 0.0031 | 0.4439 | 40.6400 | 0.0025 |
| 29 | 0.4515 | 40.1005 | 0.0374 | 0.4425 | 38.2200 | 0.0382 | 0.4399 | 38.3732 | 0.0027 | 0.4489 | 40.2527 | 0.0022 |
| 30 | 0.4562 | 39.7607 | 0.0370 | 0.4471 | 37.8188 | 0.0378 | 0.4447 | 37.9621 | 0.0024 | 0.4537 | 39.8989 | 0.0019 |
| 31 | 0.4606 | 39.4513 | 0.0367 | 0.4517 | 37.4493 | 0.0374 | 0.4495 | 37.5816 | 0.0021 | 0.4584 | 39.5750 | 0.0016 |
| 32 | 0.4650 | 39.1688 | 0.0364 | 0.4561 | 37.1079 | 0.0370 | 0.4541 | 37.2286 | 0.0019 | 0.4630 | 39.2776 | 0.0014 |
| 33 | 0.4693 | 38.9100 | 0.0361 | 0.4605 | 36.7916 | 0.0367 | 0.4586 | 36.9000 | 0.0016 | 0.4674 | 39.0037 | 0.0012 |
| 34 | 0.4733 | 38.6447 | 0.0359 | 0.4648 | 36.5262 | 0.0364 | 0.4631 | 36.6210 | 0.0014 | 0.4717 | 38.7234 | 0.0010 |
| 35 | 0.4773 | 38.3980 | 0.0357 | 0.4691 | 36.2807 | 0.0361 | 0.4675 | 36.3617 | 0.0012 | 0.4758 | 38.4620 | 0.0008 |
| 36 | 0.4812 | 38.1678 | 0.0355 | 0.4733 | 36.0530 | 0.0359 | 0.4719 | 36.1201 | 0.0010 | 0.4799 | 38.2176 | 0.0006 |
| 37 | 0.4850 | 37.9524 | 0.0354 | 0.4773 | 35.8412 | 0.0357 | 0.4761 | 35.8944 | 0.0008 | 0.4839 | 37.9883 | 0.0005 |
| 38 | 0.4888 | 37.7501 | 0.0352 | 0.4814 | 35.6436 | 0.0355 | 0.4803 | 35.6830 | 0.0006 | 0.4878 | 37.7726 | 0.0003 |
| 39 | 0.4925 | 37.5596 | 0.0351 | 0.4853 | 35.4586 | 0.0354 | 0.4845 | 35.4845 | 0.0005 | 0.4917 | 37.5691 | 0.0002 |
| 40 | 0.4961 | 37.3799 | 0.0351 | 0.4892 | 35.2853 | 0.0352 | 0.4886 | 35.2972 | 0.0003 | 0.4956 | 37.3762 | 0.0001 |
| 41 | 0.4997 | 37.2110 | 0.0350 | 0.4930 | 35.1235 | 0.0351 | 0.4927 | 35.1188 | 0.0002 | 0.4995 | 37.1914 | 0.0000 |
| 42 | 0.5037 | 37.0321 | 0.0349 | 0.4971 | 34.9542 | 0.0351 | 0.4963 | 34.9664 | 0.0001 | 0.5029 | 37.0336 | −0.0001 |
| 43 | 0.5726 | 34.3271 | 0.0349 | 0.5660 | 32.5014 | 0.0351 | 0.5653 | 32.4852 | 0.0001 | 0.5719 | 34.3076 | −0.0001 |

TABLE 2-5

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 | 0 |
| 10 | 0 | 0 | 0 | 0 | 0 | 0 | 0 | 0 | 0 | 0 | 0 | 0 |
| 11 | 0 | 0 | 0 | 0 | 0 | 0 | 0 | 0 | 0 | 0 | 0 | 0 |
| 12 | 0.3379 | 41.0216 | 0.0574 | 0.3334 | 40.5453 | 0.0587 | 0.3237 | 40.6800 | 0.0160 | 0.3283 | 41.2100 | 0.0152 |
| 13 | 0.3471 | 38.3242 | 0.0549 | 0.3422 | 37.7841 | 0.0563 | 0.3334 | 37.9789 | 0.0144 | 0.3383 | 38.5701 | 0.0136 |
| 14 | 0.3560 | 36.0053 | 0.0527 | 0.3506 | 35.3992 | 0.0540 | 0.3426 | 35.6321 | 0.0130 | 0.3479 | 36.2858 | 0.0122 |

TABLE 2-5-continued

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 15 | 0.3644 | 34.0050 | 0.0507 | 0.3587 | 33.3310 | 0.0520 | 0.3513 | 33.5846 | 0.0117 | 0.3570 | 34.3021 | 0.0109 |
| 16 | 0.3725 | 32.2741 | 0.0489 | 0.3664 | 31.5304 | 0.0503 | 0.3597 | 31.7908 | 0.0106 | 0.3656 | 32.5734 | 0.0098 |
| 17 | 0.3801 | 30.7718 | 0.0473 | 0.3738 | 29.9568 | 0.0487 | 0.3676 | 30.2132 | 0.0096 | 0.3738 | 31.0620 | 0.0088 |
| 18 | 0.3875 | 29.4643 | 0.0459 | 0.3809 | 28.5764 | 0.0472 | 0.3751 | 28.8203 | 0.0086 | 0.3816 | 29.7366 | 0.0079 |
| 19 | 0.3945 | 28.3235 | 0.0447 | 0.3877 | 27.3613 | 0.0459 | 0.3823 | 27.5863 | 0.0078 | 0.3891 | 28.5711 | 0.0071 |
| 20 | 0.4012 | 27.3219 | 0.0435 | 0.3942 | 26.2923 | 0.0448 | 0.3892 | 26.4872 | 0.0071 | 0.3961 | 27.5458 | 0.0063 |
| 21 | 0.4076 | 26.4304 | 0.0425 | 0.4004 | 25.3306 | 0.0437 | 0.3958 | 25.5169 | 0.0064 | 0.4029 | 26.6460 | 0.0057 |
| 22 | 0.4138 | 25.6376 | 0.0416 | 0.4064 | 24.4667 | 0.0428 | 0.4021 | 24.6502 | 0.0058 | 0.4094 | 25.8487 | 0.0051 |
| 23 | 0.4197 | 24.9316 | 0.0408 | 0.4121 | 23.6891 | 0.0419 | 0.4082 | 23.8713 | 0.0052 | 0.4156 | 25.1385 | 0.0045 |
| 24 | 0.4254 | 24.3014 | 0.0401 | 0.4177 | 22.9874 | 0.0411 | 0.4140 | 23.1677 | 0.0047 | 0.4216 | 24.5029 | 0.0041 |
| 25 | 0.4309 | 23.7375 | 0.0394 | 0.4231 | 22.3521 | 0.0404 | 0.4197 | 22.5295 | 0.0042 | 0.4273 | 23.9321 | 0.0036 |
| 26 | 0.4362 | 23.2316 | 0.0388 | 0.4283 | 21.7753 | 0.0398 | 0.4251 | 21.9481 | 0.0038 | 0.4329 | 23.4175 | 0.0032 |
| 27 | 0.4413 | 22.7765 | 0.0383 | 0.4333 | 21.2499 | 0.0392 | 0.4304 | 21.4165 | 0.0034 | 0.4382 | 22.9521 | 0.0028 |
| 28 | 0.4462 | 22.3660 | 0.0378 | 0.4382 | 20.7698 | 0.0387 | 0.4355 | 20.9289 | 0.0030 | 0.4434 | 22.5300 | 0.0025 |
| 29 | 0.4510 | 21.9948 | 0.0374 | 0.4430 | 20.3299 | 0.0382 | 0.4404 | 20.4800 | 0.0027 | 0.4484 | 22.1459 | 0.0022 |
| 30 | 0.4557 | 21.6581 | 0.0370 | 0.4476 | 19.9255 | 0.0377 | 0.4452 | 20.0655 | 0.0024 | 0.4532 | 21.7955 | 0.0019 |
| 31 | 0.4602 | 21.3519 | 0.0367 | 0.4521 | 19.5526 | 0.0373 | 0.4499 | 19.6817 | 0.0021 | 0.4580 | 21.4750 | 0.0017 |
| 32 | 0.4646 | 21.0726 | 0.0364 | 0.4566 | 19.2077 | 0.0370 | 0.4545 | 19.3252 | 0.0019 | 0.4625 | 21.1810 | 0.0014 |
| 33 | 0.4689 | 20.8171 | 0.0361 | 0.4609 | 18.8879 | 0.0367 | 0.4590 | 18.9931 | 0.0016 | 0.4670 | 20.9106 | 0.0012 |
| 34 | 0.4730 | 20.5827 | 0.0359 | 0.4651 | 18.5904 | 0.0364 | 0.4634 | 18.6830 | 0.0014 | 0.4714 | 20.6614 | 0.0010 |
| 35 | 0.4771 | 20.3670 | 0.0357 | 0.4692 | 18.3128 | 0.0361 | 0.4676 | 18.3926 | 0.0012 | 0.4757 | 20.4310 | 0.0008 |
| 36 | 0.4812 | 20.1678 | 0.0355 | 0.4733 | 18.0530 | 0.0359 | 0.4719 | 18.1201 | 0.0010 | 0.4799 | 20.2176 | 0.0006 |
| 37 | 0.4850 | 19.9524 | 0.0354 | 0.4773 | 17.8412 | 0.0357 | 0.4761 | 17.8944 | 0.0008 | 0.4839 | 19.9883 | 0.0005 |
| 38 | 0.4888 | 19.7501 | 0.0352 | 0.4814 | 17.6436 | 0.0355 | 0.4803 | 17.6830 | 0.0006 | 0.4878 | 19.7726 | 0.0003 |
| 39 | 0.4925 | 19.5596 | 0.0351 | 0.4853 | 17.4586 | 0.0354 | 0.4845 | 17.4845 | 0.0005 | 0.4917 | 19.5691 | 0.0002 |
| 40 | 0.4961 | 19.3799 | 0.0351 | 0.4892 | 17.2853 | 0.0352 | 0.4886 | 17.2972 | 0.0003 | 0.4956 | 19.3762 | 0.0001 |
| 41 | 0.4997 | 19.2110 | 0.0350 | 0.4930 | 17.1235 | 0.0351 | 0.4927 | 17.1188 | 0.0002 | 0.4995 | 19.1914 | 0.0000 |
| 42 | 0.5037 | 19.0321 | 0.0349 | 0.4971 | 16.9542 | 0.0351 | 0.4963 | 16.9664 | 0.0001 | 0.5029 | 19.0336 | −0.0001 |
| 43 | 0.5726 | 16.3271 | 0.0349 | 0.5660 | 14.5014 | 0.0351 | 0.5653 | 14.4852 | 0.0001 | 0.5719 | 16.3076 | −0.0001 |

TABLE 3-1

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0.2014 | 359.9196 | 0.3992 | 0.2014 | 0.0804 | 0.4022 | 0.0888 | 359.1463 | 0.3978 | 0.0888 | 0.8537 | 0.4038 |
| 2 | 0.2014 | 0.7774 | 0.3986 | 0.2014 | 0.9328 | 0.4016 | 0.0888 | 359.8805 | 0.3967 | 0.0888 | 1.9385 | 0.4036 |
| 3 | 0.2016 | 2.8740 | 0.3970 | 0.2014 | 3.0332 | 0.4003 | 0.0888 | 1.7624 | 0.3945 | 0.0887 | 4.0605 | 0.4027 |
| 4 | 0.2016 | 5.9115 | 0.3948 | 0.2014 | 6.0741 | 0.3984 | 0.0888 | 4.7636 | 0.3918 | 0.0887 | 7.2564 | 0.4008 |
| 5 | 0.2016 | 9.8325 | 0.3921 | 0.2014 | 9.9990 | 0.3959 | 0.0890 | 8.4786 | 0.3885 | 0.0889 | 11.3445 | 0.3986 |
| 6 | 0.2015 | 14.5261 | 0.3888 | 0.2015 | 14.7712 | 0.3926 | 0.0889 | 13.1397 | 0.3847 | 0.0888 | 16.2602 | 0.3956 |
| 7 | 0.2016 | 20.0561 | 0.3850 | 0.2016 | 20.3016 | 0.3891 | 0.0890 | 18.4349 | 0.3801 | 0.0889 | 21.8341 | 0.3921 |
| 8 | 0.2015 | 26.3218 | 0.3806 | 0.2015 | 26.4956 | 0.3847 | 0.0893 | 24.6036 | 0.3751 | 0.0888 | 28.3008 | 0.3880 |
| 9 | 0.2015 | 33.2160 | 0.3757 | 0.2015 | 33.4961 | 0.3801 | 0.0893 | 31.3547 | 0.3694 | 0.0890 | 35.2514 | 0.3836 |
| 10 | 0.2015 | 40.8204 | 0.3702 | 0.2016 | 41.0983 | 0.3751 | 0.0896 | 38.9328 | 0.3634 | 0.0891 | 43.1364 | 0.3784 |
| 11 | 0.2015 | 49.1796 | 0.3645 | 0.2015 | 49.3987 | 0.3694 | 0.0899 | 47.0938 | 0.3568 | 0.0893 | 51.5867 | 0.3730 |
| 12 | 0.2015 | 58.0770 | 0.3582 | 0.2015 | 58.3569 | 0.3634 | 0.0905 | 55.8301 | 0.3500 | 0.0894 | 60.5374 | 0.3669 |
| 13 | 0.2014 | 67.6790 | 0.3516 | 0.2016 | 67.9535 | 0.3571 | 0.0908 | 65.2850 | 0.3423 | 0.0897 | 70.2405 | 0.3604 |
| 14 | 0.2015 | 77.8673 | 0.3445 | 0.2015 | 78.1874 | 0.3503 | 0.0915 | 75.4655 | 0.3344 | 0.0900 | 80.5663 | 0.3536 |
| 15 | 0.2014 | 88.6786 | 0.3372 | 0.2014 | 88.9895 | 0.3429 | 0.0923 | 86.0957 | 0.3262 | 0.0905 | 91.4833 | 0.3462 |
| 16 | 0.2015 | 100.0755 | 0.3292 | 0.2014 | 100.3952 | 0.3352 | 0.0932 | 97.5835 | 0.3178 | 0.0911 | 102.8271 | 0.3380 |
| 17 | 0.2015 | 111.9745 | 0.3208 | 0.2015 | 112.3928 | 0.3270 | 0.0940 | 109.6986 | 0.3093 | 0.0918 | 114.8109 | 0.3292 |
| 18 | 0.2016 | 124.5085 | 0.3120 | 0.2015 | 124.8966 | 0.3186 | 0.0953 | 122.2318 | 0.3000 | 0.0928 | 127.3423 | 0.3199 |
| 19 | 0.2015 | 137.5277 | 0.3033 | 0.2014 | 137.9146 | 0.3096 | 0.0966 | 135.2292 | 0.2904 | 0.0939 | 140.1944 | 0.3104 |
| 20 | 0.2016 | 150.9680 | 0.2937 | 0.2014 | 151.3833 | 0.3003 | 0.0978 | 148.7070 | 0.2806 | 0.0951 | 153.7295 | 0.3005 |
| 21 | 0.2016 | 164.8334 | 0.2842 | 0.2015 | 165.2288 | 0.2904 | 0.0996 | 162.6085 | 0.2702 | 0.0963 | 167.3830 | 0.2902 |
| 22 | 0.2014 | 178.9117 | 0.2740 | 0.2014 | 179.3248 | 0.2803 | 0.1015 | 176.7603 | 0.2596 | 0.0981 | 181.5114 | 0.2795 |
| 23 | 0.2015 | 193.2450 | 0.2634 | 0.2016 | 193.6407 | 0.2699 | 0.1036 | 191.1024 | 0.2484 | 0.1000 | 195.8594 | 0.2683 |
| 24 | 0.2015 | 207.7115 | 0.2527 | 0.2014 | 208.1639 | 0.2590 | 0.1061 | 205.6410 | 0.2369 | 0.1019 | 210.2786 | 0.2566 |
| 25 | 0.2015 | 222.2528 | 0.2415 | 0.2015 | 222.6918 | 0.2478 | 0.1086 | 220.3041 | 0.2251 | 0.1043 | 224.7878 | 0.2448 |
| 26 | 0.2015 | 236.7840 | 0.2301 | 0.2014 | 237.2368 | 0.2363 | 0.1114 | 234.7892 | 0.2128 | 0.1068 | 239.2373 | 0.2322 |
| 27 | 0.2015 | 251.1719 | 0.2180 | 0.2015 | 251.6633 | 0.2243 | 0.1146 | 249.1881 | 0.2003 | 0.1096 | 253.6427 | 0.2197 |
| 28 | 0.2015 | 265.4106 | 0.2057 | 0.2016 | 265.8812 | 0.2120 | 0.1180 | 263.4840 | 0.1874 | 0.1129 | 267.7814 | 0.2066 |
| 29 | 0.2015 | 279.2836 | 0.1932 | 0.2016 | 279.8325 | 0.1995 | 0.1218 | 277.4757 | 0.1740 | 0.1167 | 281.7573 | 0.1932 |
| 30 | 0.2014 | 292.9128 | 0.1803 | 0.2014 | 293.5048 | 0.1866 | 0.1251 | 291.1274 | 0.1601 | 0.1204 | 295.4018 | 0.1795 |
| 31 | 0.2014 | 306.1703 | 0.1669 | 0.2015 | 306.7300 | 0.1732 | 0.1284 | 304.3327 | 0.1462 | 0.1240 | 308.5613 | 0.1653 |
| 32 | 0.2016 | 319.0113 | 0.1536 | 0.2016 | 319.6177 | 0.1598 | 0.1315 | 317.1897 | 0.1317 | 0.1275 | 321.4360 | 0.1508 |

TABLE 3-2

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 1 | 2 | 3 | 4 | 5 | 6 | 7 | 8 | 9 | 10 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 | 0 |
| 10 | 0 | 0 | 0 | 0 | 0 | 0 | 0 | 0 | 0 | 0 | 0 | 0 |
| 11 | 0 | 0 | 0 | 0 | 0 | 0 | 0 | 0 | 0 | 0 | 0 | 0 |
| 12 | 0 | 0 | 0 | 0 | 0 | 0 | 0 | 0 | 0 | 0 | 0 | 0 |
| 13 | 0 | 0 | 0 | 0 | 0 | 0 | 0 | 0 | 0 | 0 | 0 | 0 |
| 14 | 0 | 0 | 0 | 0 | 0 | 0 | 0 | 0 | 0 | 0 | 0 | 0 |
| 15 | 0 | 0 | 0 | 0 | 0 | 0 | 0 | 0 | 0 | 0 | 0 | 0 |
| 16 | 0 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 | 0 |
| 18 | 0 | 0 | 0 | 0 | 0 | 0 | 0 | 0 | 0 | 0 | 0 | 0 |
| 19 | 0 | 0 | 0 | 0 | 0 | 0 | 0 | 0 | 0 | 0 | 0 | 0 |
| 20 | 0 | 0 | 0 | 0 | 0 | 0 | 0 | 0 | 0 | 0 | 0 | 0 |
| 21 | 0 | 0 | 0 | 0 | 0 | 0 | 0 | 0 | 0 | 0 | 0 | 0 |
| 22 | 0.2016 | 119.0320 | 0.2760 | 0.2016 | 119.2055 | 0.2787 | 0.1005 | 118.2374 | 0.2658 | 0.0992 | 120.0973 | 0.2732 |
| 23 | 0.2014 | 133.3509 | 0.2653 | 0.2014 | 133.5707 | 0.2683 | 0.1025 | 132.4072 | 0.2538 | 0.1009 | 134.5610 | 0.2628 |
| 24 | 0.2015 | 147.7970 | 0.2541 | 0.2015 | 148.0770 | 0.2577 | 0.1050 | 146.6822 | 0.2413 | 0.1027 | 149.2716 | 0.2522 |
| 25 | 0.2016 | 162.3263 | 0.2426 | 0.2015 | 162.6460 | 0.2467 | 0.1077 | 161.0596 | 0.2287 | 0.1049 | 163.9726 | 0.2413 |
| 26 | 0.2014 | 176.8115 | 0.2309 | 0.2016 | 177.2035 | 0.2355 | 0.1108 | 175.3303 | 0.2156 | 0.1074 | 178.6536 | 0.2298 |
| 27 | 0.2014 | 191.1880 | 0.2186 | 0.2014 | 191.5844 | 0.2238 | 0.1142 | 189.6426 | 0.2019 | 0.1100 | 193.2079 | 0.2180 |
| 28 | 0.2014 | 205.3831 | 0.2060 | 0.2015 | 205.8007 | 0.2117 | 0.1178 | 203.6522 | 0.1883 | 0.1132 | 207.6168 | 0.2057 |
| 29 | 0.2015 | 219.2785 | 0.1932 | 0.2014 | 219.8255 | 0.1995 | 0.1218 | 217.4354 | 0.1740 | 0.1167 | 221.6781 | 0.1932 |
| 30 | 0.2015 | 232.9903 | 0.1803 | 0.2016 | 233.4873 | 0.1866 | 0.1251 | 231.0275 | 0.1601 | 0.1204 | 235.2637 | 0.1795 |
| 31 | 0.2016 | 246.1794 | 0.1669 | 0.2016 | 246.7708 | 0.1732 | 0.1284 | 244.4161 | 0.1462 | 0.1242 | 248.5732 | 0.1653 |
| 32 | 0.2015 | 258.9795 | 0.1536 | 0.2014 | 259.6048 | 0.1598 | 0.1317 | 257.1747 | 0.1317 | 0.1274 | 261.3659 | 0.1508 |

TABLE 3-3

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0.2246 | 4.1154 | 0.1115 | 0.2209 | 4.3987 | 0.1153 | 0.1820 | 0.2174 | 0.0634 | 0.1863 | 359.7826 | 0.0607 |
| 2 | 0.2336 | 18.9011 | 0.1044 | 0.2292 | 19.2127 | 0.1082 | 0.1960 | 19.2938 | 0.0555 | 0.2011 | 18.7795 | 0.0527 |
| 3 | 0.2437 | 33.0131 | 0.0975 | 0.2385 | 33.3624 | 0.1014 | 0.2099 | 35.5723 | 0.0489 | 0.2160 | 35.0573 | 0.0462 |
| 4 | 0.2545 | 46.0875 | 0.0910 | 0.2483 | 46.4711 | 0.0948 | 0.2241 | 49.6488 | 0.0432 | 0.2307 | 49.0822 | 0.0407 |
| 5 | 0.2658 | 57.8947 | 0.0850 | 0.2591 | 58.3212 | 0.0888 | 0.2376 | 61.7260 | 0.0383 | 0.2449 | 61.1192 | 0.0358 |
| 6 | 0.2773 | 68.4397 | 0.0795 | 0.2697 | 68.9208 | 0.0833 | 0.2512 | 72.1366 | 0.0339 | 0.2590 | 71.4886 | 0.0317 |
| 7 | 0.2886 | 77.7007 | 0.0749 | 0.2805 | 78.2522 | 0.0784 | 0.2638 | 81.1230 | 0.0303 | 0.2723 | 80.4715 | 0.0279 |
| 8 | 0.2997 | 85.8697 | 0.0705 | 0.2910 | 86.4472 | 0.0740 | 0.2763 | 88.9234 | 0.0270 | 0.2854 | 88.1895 | 0.0246 |
| 9 | 0.3108 | 93.0234 | 0.0667 | 0.3012 | 93.6412 | 0.0702 | 0.2880 | 95.6619 | 0.0240 | 0.2978 | 94.9470 | 0.0219 |
| 10 | 0.3212 | 99.3021 | 0.0631 | 0.3110 | 99.9672 | 0.0667 | 0.2993 | 101.5869 | 0.0216 | 0.3096 | 100.7843 | 0.0194 |
| 11 | 0.3315 | 104.8037 | 0.0601 | 0.3206 | 105.4692 | 0.0637 | 0.3099 | 106.7573 | 0.0194 | 0.3208 | 105.9186 | 0.0172 |
| 12 | 0.3411 | 109.6106 | 0.0577 | 0.3299 | 110.3561 | 0.0609 | 0.3202 | 111.2657 | 0.0175 | 0.3315 | 110.4068 | 0.0153 |
| 13 | 0.3505 | 113.8672 | 0.0552 | 0.3385 | 114.6621 | 0.0585 | 0.3296 | 115.2694 | 0.0158 | 0.3415 | 114.3302 | 0.0137 |
| 14 | 0.3595 | 117.6166 | 0.0530 | 0.3468 | 118.4628 | 0.0563 | 0.3390 | 118.8169 | 0.0142 | 0.3513 | 117.8208 | 0.0123 |
| 15 | 0.3679 | 120.9273 | 0.0511 | 0.3550 | 121.8184 | 0.0541 | 0.3475 | 121.9528 | 0.0128 | 0.3605 | 120.9191 | 0.0109 |
| 16 | 0.3761 | 123.8632 | 0.0495 | 0.3625 | 124.8399 | 0.0525 | 0.3558 | 124.7397 | 0.0115 | 0.3690 | 123.6783 | 0.0096 |
| 17 | 0.3841 | 126.4949 | 0.0481 | 0.3700 | 127.5299 | 0.0508 | 0.3635 | 127.2403 | 0.0104 | 0.3774 | 126.1067 | 0.0087 |
| 18 | 0.3915 | 128.8534 | 0.0467 | 0.3767 | 129.9386 | 0.0495 | 0.3711 | 129.5031 | 0.0096 | 0.3852 | 128.3170 | 0.0077 |
| 19 | 0.3986 | 130.9421 | 0.0456 | 0.3834 | 132.1116 | 0.0484 | 0.3782 | 131.5442 | 0.0085 | 0.3929 | 130.2902 | 0.0068 |
| 20 | 0.4054 | 132.8425 | 0.0445 | 0.3899 | 134.0915 | 0.0470 | 0.3848 | 133.3601 | 0.0079 | 0.4001 | 132.0657 | 0.0060 |
| 21 | 0.4119 | 134.5700 | 0.0437 | 0.3961 | 135.8384 | 0.0462 | 0.3914 | 135.0566 | 0.0071 | 0.4070 | 133.6943 | 0.0055 |
| 22 | 0.4182 | 136.1119 | 0.0426 | 0.4020 | 137.4513 | 0.0451 | 0.3974 | 136.6159 | 0.0063 | 0.4136 | 135.2408 | 0.0046 |
| 23 | 0.4241 | 137.5326 | 0.0421 | 0.4076 | 138.8863 | 0.0443 | 0.4036 | 138.0186 | 0.0057 | 0.4198 | 136.6351 | 0.0041 |
| 24 | 0.4297 | 138.8415 | 0.0413 | 0.4136 | 140.1993 | 0.0434 | 0.4096 | 139.3282 | 0.0052 | 0.4256 | 137.9663 | 0.0038 |
| 25 | 0.4350 | 140.0193 | 0.0407 | 0.4190 | 141.4336 | 0.0426 | 0.4154 | 140.5515 | 0.0046 | 0.4314 | 139.1862 | 0.0033 |
| 26 | 0.4403 | 141.1459 | 0.0402 | 0.4244 | 142.5326 | 0.0421 | 0.4210 | 141.6945 | 0.0041 | 0.4368 | 140.3046 | 0.0030 |
| 27 | 0.4451 | 142.1805 | 0.0399 | 0.4295 | 143.5894 | 0.0415 | 0.4261 | 142.7921 | 0.0038 | 0.4421 | 141.4231 | 0.0025 |
| 28 | 0.4501 | 143.1440 | 0.0393 | 0.4343 | 144.5503 | 0.0410 | 0.4313 | 143.8125 | 0.0033 | 0.4471 | 142.4229 | 0.0022 |
| 29 | 0.4549 | 144.0662 | 0.0391 | 0.4393 | 145.4401 | 0.0404 | 0.4366 | 144.7583 | 0.0030 | 0.4521 | 143.3794 | 0.0019 |
| 30 | 0.4595 | 144.9019 | 0.0388 | 0.4439 | 146.3197 | 0.0399 | 0.4414 | 145.6705 | 0.0026 | 0.4569 | 144.2950 | 0.0016 |
| 31 | 0.4639 | 145.7296 | 0.0383 | 0.4484 | 147.1137 | 0.0396 | 0.4460 | 146.5436 | 0.0023 | 0.4615 | 145.1997 | 0.0013 |
| 32 | 0.4682 | 146.4954 | 0.0380 | 0.4529 | 147.8920 | 0.0393 | 0.4506 | 147.3796 | 0.0020 | 0.4661 | 146.0398 | 0.0011 |
| 33 | 0.4725 | 147.2289 | 0.0380 | 0.4572 | 148.6370 | 0.0388 | 0.4550 | 148.1806 | 0.0017 | 0.4706 | 146.8450 | 0.0009 |
| 34 | 0.4768 | 147.9494 | 0.0377 | 0.4612 | 149.3331 | 0.0385 | 0.4595 | 148.9661 | 0.0015 | 0.4750 | 147.6173 | 0.0007 |
| 35 | 0.4809 | 148.6399 | 0.0374 | 0.4656 | 150.0049 | 0.0383 | 0.4637 | 149.6731 | 0.0013 | 0.4794 | 148.3754 | 0.0006 |

TABLE 3-3-continued

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 36 | 0.4849 | 149.3020 | 0.0372 | 0.4695 | 150.6604 | 0.0380 | 0.4681 | 150.4127 | 0.0011 | 0.4837 | 149.1029 | 0.0004 |
| 37 | 0.4889 | 149.9533 | 0.0372 | 0.4734 | 151.3051 | 0.0377 | 0.4722 | 151.1064 | 0.0009 | 0.4878 | 149.8013 | 0.0003 |
| 38 | 0.4928 | 150.5782 | 0.0369 | 0.4774 | 151.9391 | 0.0377 | 0.4762 | 151.7883 | 0.0007 | 0.4918 | 150.5157 | 0.0002 |
| 39 | 0.4966 | 151.2210 | 0.0369 | 0.4812 | 152.5475 | 0.0374 | 0.4804 | 152.4585 | 0.0005 | 0.4959 | 151.1754 | 0.0000 |
| 40 | 0.5006 | 151.8263 | 0.0369 | 0.4849 | 153.1317 | 0.0374 | 0.4842 | 153.1313 | 0.0004 | 0.4998 | 151.8520 | 0.0000 |
| 41 | 0.5042 | 152.4352 | 0.0366 | 0.4885 | 153.7072 | 0.0372 | 0.4883 | 153.7647 | 0.0003 | 0.5039 | 152.5178 | −0.0001 |
| 42 | 0.5082 | 153.1181 | 0.0366 | 0.4925 | 154.3590 | 0.0372 | 0.4916 | 154.3464 | 0.0002 | 0.5073 | 153.1038 | −0.0002 |
| 43 | 0.5765 | 161.9429 | 0.0366 | 0.5609 | 163.0655 | 0.0372 | 0.5601 | 163.1562 | 0.0002 | 0.5757 | 162.0036 | −0.0002 |

TABLE 3-4

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0.2759 | 113.5189 | 0.0803 | 0.2711 | 113.7749 | 0.0825 | 0.2525 | 117.0365 | 0.0336 | 0.2573 | 116.6195 | 0.0320 |
| 7 | 0.2870 | 122.7975 | 0.0754 | 0.2819 | 123.1356 | 0.0779 | 0.2654 | 125.9970 | 0.0298 | 0.2708 | 125.5982 | 0.0284 |
| 8 | 0.2983 | 130.9884 | 0.0710 | 0.2925 | 131.3269 | 0.0735 | 0.2779 | 133.8049 | 0.0265 | 0.2837 | 133.3612 | 0.0251 |
| 9 | 0.3090 | 138.1182 | 0.0672 | 0.3027 | 138.5125 | 0.0694 | 0.2898 | 140.5472 | 0.0238 | 0.2962 | 140.0523 | 0.0224 |
| 10 | 0.3196 | 144.3940 | 0.0637 | 0.3128 | 144.8522 | 0.0661 | 0.3010 | 146.4398 | 0.0213 | 0.3077 | 145.9290 | 0.0199 |
| 11 | 0.3297 | 149.9076 | 0.0607 | 0.3224 | 150.3936 | 0.0631 | 0.3119 | 151.5939 | 0.0191 | 0.3191 | 151.0645 | 0.0178 |
| 12 | 0.3393 | 154.7350 | 0.0582 | 0.3315 | 155.2512 | 0.0604 | 0.3221 | 156.1313 | 0.0172 | 0.3296 | 155.5167 | 0.0158 |
| 13 | 0.3486 | 158.9657 | 0.0557 | 0.3406 | 159.5300 | 0.0579 | 0.3315 | 160.1016 | 0.0153 | 0.3396 | 159.4655 | 0.0139 |
| 14 | 0.3573 | 162.7427 | 0.0536 | 0.3488 | 163.3394 | 0.0557 | 0.3408 | 163.6571 | 0.0139 | 0.3492 | 162.9830 | 0.0126 |
| 15 | 0.3660 | 166.0467 | 0.0516 | 0.3569 | 166.6766 | 0.0538 | 0.3494 | 166.8005 | 0.0126 | 0.3584 | 166.0591 | 0.0112 |
| 16 | 0.3741 | 169.0102 | 0.0500 | 0.3646 | 169.6836 | 0.0519 | 0.3578 | 169.5738 | 0.0112 | 0.3670 | 168.8406 | 0.0101 |
| 17 | 0.3819 | 171.6496 | 0.0486 | 0.3722 | 172.3637 | 0.0505 | 0.3658 | 172.0999 | 0.0101 | 0.3754 | 171.2919 | 0.0090 |
| 18 | 0.3893 | 173.9973 | 0.0473 | 0.3792 | 174.7906 | 0.0492 | 0.3731 | 174.3270 | 0.0093 | 0.3831 | 173.4883 | 0.0079 |
| 19 | 0.3963 | 176.1255 | 0.0459 | 0.3858 | 176.9147 | 0.0478 | 0.3803 | 176.3749 | 0.0085 | 0.3906 | 175.4660 | 0.0071 |
| 20 | 0.4032 | 178.0197 | 0.0448 | 0.3922 | 178.8822 | 0.0467 | 0.3871 | 178.1798 | 0.0077 | 0.3977 | 177.2831 | 0.0063 |
| 21 | 0.4096 | 179.7480 | 0.0440 | 0.3984 | 180.6287 | 0.0456 | 0.3937 | 179.8670 | 0.0068 | 0.4047 | 178.9169 | 0.0057 |
| 22 | 0.4160 | 181.2797 | 0.0432 | 0.4041 | 182.2473 | 0.0448 | 0.3998 | 181.4096 | 0.0063 | 0.4112 | 180.4188 | 0.0049 |
| 23 | 0.4218 | 182.7104 | 0.0423 | 0.4099 | 183.7074 | 0.0440 | 0.4057 | 182.8566 | 0.0055 | 0.4177 | 181.7993 | 0.0044 |
| 24 | 0.4278 | 183.9918 | 0.0415 | 0.4155 | 185.0171 | 0.0432 | 0.4115 | 184.1886 | 0.0049 | 0.4238 | 183.1040 | 0.0038 |
| 25 | 0.4332 | 185.1748 | 0.0410 | 0.4208 | 186.2621 | 0.0426 | 0.4172 | 185.4119 | 0.0044 | 0.4296 | 184.3037 | 0.0036 |
| 26 | 0.4387 | 186.2574 | 0.0404 | 0.4257 | 187.4124 | 0.0418 | 0.4224 | 186.5734 | 0.0041 | 0.4353 | 185.4386 | 0.0030 |
| 27 | 0.4440 | 187.2824 | 0.0399 | 0.4306 | 188.4643 | 0.0413 | 0.4273 | 187.6794 | 0.0036 | 0.4408 | 186.5127 | 0.0026 |
| 28 | 0.4491 | 188.2188 | 0.0396 | 0.4354 | 189.4623 | 0.0407 | 0.4323 | 188.7241 | 0.0033 | 0.4462 | 187.5297 | 0.0023 |
| 29 | 0.4541 | 189.1053 | 0.0391 | 0.4400 | 190.3749 | 0.0404 | 0.4371 | 189.6802 | 0.0030 | 0.4514 | 188.4587 | 0.0019 |
| 30 | 0.4588 | 189.9447 | 0.0388 | 0.4446 | 191.2340 | 0.0399 | 0.4420 | 190.6153 | 0.0026 | 0.4564 | 189.3721 | 0.0016 |
| 31 | 0.4636 | 190.7669 | 0.0385 | 0.4488 | 192.0899 | 0.0396 | 0.4464 | 191.5094 | 0.0023 | 0.4612 | 190.2381 | 0.0014 |
| 32 | 0.4682 | 191.5132 | 0.0380 | 0.4532 | 192.8548 | 0.0391 | 0.4509 | 192.3518 | 0.0020 | 0.4660 | 191.0530 | 0.0011 |
| 33 | 0.4725 | 192.2197 | 0.0380 | 0.4571 | 193.6209 | 0.0388 | 0.4552 | 193.1854 | 0.0017 | 0.4706 | 191.8253 | 0.0009 |
| 34 | 0.4769 | 192.9454 | 0.0377 | 0.4614 | 194.3325 | 0.0385 | 0.4594 | 193.9371 | 0.0015 | 0.4751 | 192.6217 | 0.0007 |
| 35 | 0.4808 | 193.6414 | 0.0374 | 0.4656 | 194.9986 | 0.0383 | 0.4638 | 194.6748 | 0.0013 | 0.4794 | 193.3789 | 0.0006 |
| 36 | 0.4849 | 194.2868 | 0.0372 | 0.4696 | 195.6615 | 0.0380 | 0.4679 | 195.4077 | 0.0011 | 0.4837 | 194.0912 | 0.0004 |
| 37 | 0.4890 | 194.9603 | 0.0372 | 0.4735 | 196.3224 | 0.0377 | 0.4721 | 196.0957 | 0.0009 | 0.4878 | 194.7991 | 0.0003 |
| 38 | 0.4927 | 195.6006 | 0.0369 | 0.4773 | 196.9412 | 0.0377 | 0.4763 | 196.8031 | 0.0007 | 0.4919 | 195.4952 | 0.0002 |
| 39 | 0.4966 | 196.2312 | 0.0369 | 0.4811 | 197.5501 | 0.0374 | 0.4803 | 197.4454 | 0.0005 | 0.4959 | 196.1882 | 0.0000 |
| 40 | 0.5004 | 196.8221 | 0.0369 | 0.4850 | 198.1185 | 0.0374 | 0.4844 | 198.1079 | 0.0004 | 0.4999 | 196.8402 | 0.0000 |
| 41 | 0.5041 | 197.4430 | 0.0366 | 0.4887 | 198.7186 | 0.0372 | 0.4883 | 198.7695 | 0.0003 | 0.5040 | 197.5115 | −0.0001 |
| 42 | 0.5082 | 198.1038 | 0.0366 | 0.4926 | 199.3695 | 0.0372 | 0.4917 | 199.3411 | 0.0002 | 0.5074 | 198.1032 | −0.0002 |
| 43 | 0.5765 | 206.9415 | 0.0366 | 0.5608 | 208.0758 | 0.0372 | 0.5602 | 208.1399 | 0.0002 | 0.5757 | 207.0150 | −0.0002 |

TABLE 3-5

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 1 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 |
| 7 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 | 0 |

TABLE 3-5-continued

| station number | R/D2 | Theta | Z/D2 | R/D2 | Theta | Z/D2 | R/D2 | Theta | Z/D2 | R/D2 | Theta | Z/D2 |
|---|---|---|---|---|---|---|---|---|---|---|---|---|
| | shroud pressure side | | | shroud suction side | | | hub suction side | | | hub pressure side | | |
| 10 | 0 | 0 | 0 | 0 | 0 | 0 | 0 | 0 | 0 | 0 | 0 | 0 |
| 11 | 0 | 0 | 0 | 0 | 0 | 0 | 0 | 0 | 0 | 0 | 0 | 0 |
| 12 | 0 | 0 | 0 | 0 | 0 | 0 | 0 | 0 | 0 | 0 | 0 | 0 |
| 13 | 0 | 0 | 0 | 0 | 0 | 0 | 0 | 0 | 0 | 0 | 0 | 0 |
| 14 | 0 | 0 | 0 | 0 | 0 | 0 | 0 | 0 | 0 | 0 | 0 | 0 |
| 15 | 0.3640 | 143.7323 | 0.0522 | 0.3590 | 144.0720 | 0.0533 | 0.3516 | 144.1363 | 0.0123 | 0.3565 | 143.7273 | 0.0115 |
| 16 | 0.3721 | 146.6833 | 0.0505 | 0.3666 | 147.0441 | 0.0516 | 0.3597 | 146.9013 | 0.0109 | 0.3651 | 146.4764 | 0.0104 |
| 17 | 0.3798 | 149.2837 | 0.0489 | 0.3740 | 149.7255 | 0.0500 | 0.3675 | 149.4308 | 0.0098 | 0.3735 | 148.9500 | 0.0093 |
| 18 | 0.3874 | 151.6637 | 0.0475 | 0.3808 | 152.1113 | 0.0486 | 0.3749 | 151.6794 | 0.0090 | 0.3813 | 151.1209 | 0.0082 |
| 19 | 0.3944 | 153.7722 | 0.0462 | 0.3875 | 154.3022 | 0.0475 | 0.3821 | 153.7281 | 0.0082 | 0.3889 | 153.1469 | 0.0074 |
| 20 | 0.4015 | 155.6851 | 0.0451 | 0.3940 | 156.2432 | 0.0464 | 0.3887 | 155.5427 | 0.0074 | 0.3961 | 154.9019 | 0.0066 |
| 21 | 0.4079 | 157.3860 | 0.0443 | 0.4001 | 158.0242 | 0.0454 | 0.3953 | 157.2278 | 0.0066 | 0.4030 | 156.5464 | 0.0057 |
| 22 | 0.4143 | 158.9354 | 0.0434 | 0.4058 | 159.5884 | 0.0445 | 0.4013 | 158.7636 | 0.0060 | 0.4097 | 158.0709 | 0.0052 |
| 23 | 0.4204 | 160.3286 | 0.0426 | 0.4116 | 161.0599 | 0.0437 | 0.4074 | 160.2040 | 0.0055 | 0.4161 | 159.4351 | 0.0046 |
| 24 | 0.4261 | 161.6115 | 0.0418 | 0.4168 | 162.4084 | 0.0429 | 0.4130 | 161.5651 | 0.0049 | 0.4223 | 160.7327 | 0.0041 |
| 25 | 0.4319 | 162.7800 | 0.0413 | 0.4220 | 163.6419 | 0.0423 | 0.4185 | 162.7955 | 0.0044 | 0.4282 | 161.9350 | 0.0036 |
| 26 | 0.4374 | 163.8973 | 0.0407 | 0.4270 | 164.7899 | 0.0418 | 0.4236 | 163.9734 | 0.0038 | 0.4338 | 163.0830 | 0.0030 |
| 27 | 0.4426 | 164.9000 | 0.0402 | 0.4320 | 165.8319 | 0.0413 | 0.4287 | 165.0780 | 0.0036 | 0.4394 | 164.1231 | 0.0027 |
| 28 | 0.4478 | 165.8366 | 0.0396 | 0.4366 | 166.8334 | 0.0407 | 0.4337 | 166.1126 | 0.0033 | 0.4450 | 165.1275 | 0.0023 |
| 29 | 0.4528 | 166.7100 | 0.0391 | 0.4412 | 167.7714 | 0.0402 | 0.4384 | 167.0723 | 0.0027 | 0.4501 | 166.0565 | 0.0020 |
| 30 | 0.4577 | 167.5565 | 0.0388 | 0.4456 | 168.6487 | 0.0399 | 0.4430 | 168.0385 | 0.0025 | 0.4552 | 166.9564 | 0.0017 |
| 31 | 0.4625 | 168.3449 | 0.0385 | 0.4499 | 169.4680 | 0.0393 | 0.4474 | 168.9096 | 0.0022 | 0.4601 | 167.8292 | 0.0014 |
| 32 | 0.4672 | 169.1107 | 0.0383 | 0.4541 | 170.2656 | 0.0391 | 0.4520 | 169.7633 | 0.0019 | 0.4648 | 168.6438 | 0.0012 |
| 33 | 0.4716 | 169.8228 | 0.0380 | 0.4580 | 171.0434 | 0.0388 | 0.4561 | 170.5885 | 0.0017 | 0.4697 | 169.4418 | 0.0010 |
| 34 | 0.4759 | 170.5160 | 0.0377 | 0.4621 | 171.7741 | 0.0385 | 0.4601 | 171.3935 | 0.0015 | 0.4744 | 170.1851 | 0.0008 |
| 35 | 0.4803 | 171.1646 | 0.0374 | 0.4661 | 172.4542 | 0.0383 | 0.4642 | 172.1513 | 0.0012 | 0.4790 | 170.9084 | 0.0006 |
| 36 | 0.4847 | 171.8334 | 0.0372 | 0.4697 | 173.1519 | 0.0380 | 0.4683 | 172.8957 | 0.0010 | 0.4833 | 171.6134 | 0.0004 |
| 37 | 0.4889 | 172.4540 | 0.0372 | 0.4735 | 173.8058 | 0.0377 | 0.4720 | 173.6195 | 0.0009 | 0.4877 | 172.3057 | 0.0003 |
| 38 | 0.4927 | 173.0878 | 0.0369 | 0.4774 | 174.4167 | 0.0377 | 0.4761 | 174.3025 | 0.0007 | 0.4919 | 173.0131 | 0.0002 |
| 39 | 0.4967 | 173.7155 | 0.0369 | 0.4810 | 175.0472 | 0.0374 | 0.4803 | 174.9738 | 0.0005 | 0.4959 | 173.6738 | 0.0000 |
| 40 | 0.5005 | 174.3299 | 0.0369 | 0.4850 | 175.6384 | 0.0374 | 0.4842 | 175.5988 | 0.0004 | 0.5000 | 174.3548 | 0.0000 |
| 41 | 0.5042 | 174.9321 | 0.0366 | 0.4885 | 176.2158 | 0.0372 | 0.4882 | 176.2776 | 0.0003 | 0.5038 | 175.0222 | −0.0001 |
| 42 | 0.5083 | 175.5918 | 0.0366 | 0.4925 | 176.8519 | 0.0372 | 0.4917 | 176.8467 | 0.0002 | 0.5075 | 175.6155 | −0.0002 |
| 43 | 0.5766 | 184.4299 | 0.0366 | 0.5608 | 185.5634 | 0.0372 | 0.5601 | 185.6550 | 0.0002 | 0.5758 | 184.5176 | −0.0002 |

Although example embodiments have been disclosed, a worker of ordinary skill in this art would recognize that certain modifications would come within the scope of the claims. For that reason, the following claims should be studied to determine their true scope and content.

What is claimed is:

1. A centrifugal boost pump inducer section comprising:

a plurality of main blades, and a plurality of splitter blades, each of which includes normal to the blade mean line cross sectional surfaces distributed over the length of the blades, the cross sectional surfaces defined as a set of cylindrical coordinates, wherein a Z-axis aligns with a rotational axis of the blades, an R coordinate corresponds to the distance from the Z axis and a theta coordinate is the relative angular position, said coordinates relative to a value D2 which corresponds to an impeller outer diameter, set out in one set of tables, TABLE 1-1 for the main blades and TABLE 1-2 for the splitter blades, or TABLE 2-1 for the main blades and TABLE 2-2 for the splitter blades, or TABLE 3-1 for the main blades and TABLE 3-2 for the splitter blades.

2. A centrifugal boost pump impeller section comprising:

a plurality of main blades, a plurality of primary splitter blades, and a plurality of secondary splitter blades, each of which includes normal to the blade mean line cross sectional surfaces distributed over the length of the blades, the cross sectional surfaces defined as a set of cylindrical coordinates, wherein a Z-axis aligns with a rotational axis of the blades, an R coordinate corresponds to a distance from the Z axis and a theta coordinate is the relative angular position, said coordinates relative to a value D2 which corresponds to an impeller outer diameter, set out in one set of tables, TABLE 1-3 for the main blades, TABLE 1-4 for the primary splitter blades, and TABLE 1-5 for the secondary splitter blades, or TABLE 2-3 for the main blades, TABLE 2-4 for the primary splitter blades and TABLE 2-5 for the secondary splitter blades, or TABLE 3-3 for the main blades, TABLE 3-4 for the primary splitter blades and TABLE 3-5 for the secondary splitter blades.

3. A centrifugal boost pump impeller comprising:

an inducer section including a plurality of inducer main blades, and a plurality of inducer splitter blades, each of which includes normal to the blade mean line cross sectional surfaces distributed over the length of the blades, the cross sectional surfaces defined as a set of cylindrical coordinates, wherein a Z-axis aligns with a rotational axis of the blades, an R coordinate corresponds to the distance from the Z axis and a theta coordinate is the relative angular position, said coordinates relative to a value D2 which corresponds to an impeller outer diameter, set out in one set of tables, TABLE 1-1 for the main blades and TABLE 1-2 for the splitter blades, or TABLE 2-1 for the main blades and TABLE 2-2 for the splitter blades, or TABLE 3-1 for the main blades and TABLE 3-2 for the splitter blades; and an impeller section including a plurality of impeller main blades, a plurality of impeller primary splitter blades, and a plurality of impeller secondary splitter blades, each of which includes normal to the blade mean line cross sectional surfaces distributed over the length of the blades, the cross sectional surfaces defined as a set of cylindrical coordinates, wherein a Z-axis aligns with a rotational axis of the blades, an R coordinate corresponds to a distance from the Z axis and a theta coordinate is the relative angular position, said coordinates relative to the value D2 which corresponds to the impeller outer diameter, set out in one set of tables, TABLE 1-3 for the main blades, TABLE 1-4 for the primary splitter blades and TABLE 1-5 for the secondary splitter blades, or TABLE 2-3 for the main blades, TABLE 2-4 for the primary splitter blades and TABLE 2-5 for the secondary splitter blades, or TABLE 3-3 for the main blades, TABLE 3-4 for the primary splitter blades and TABLE 3-5 for the secondary splitter blades.

4. The centrifugal boost pump impeller according to claim 3, wherein an inner diameter of the main impeller blades is approximately equal to an outer diameter of the inducer blades.

5. The centrifugal boost pump impeller according to claim 3, comprising a shroud secured to a hub, the hub providing the impeller and inducer blades integrally therewith.

6. A method of assembling a centrifugal boost pump comprising:

providing a shaft; and mounting an impeller on the shaft, the impeller including:

an inducer section including a plurality of inducer main blades, and a plurality of inducer splitter blades, each of which includes normal to the blade mean line cross sectional surfaces distributed over the length of the blades, the cross sectional surfaces defined as a set of cylindrical coordinates, wherein a Z-axis aligns with a rotational axis of the blades, an R coordinate corresponds to the distance from the Z axis and a theta coordinate is the relative angular position, said coordinates relative to a value D2 which corresponds to an impeller outer diameter, set out in one set of tables, TABLE 1-1 for the main blades and TABLE 1-2 for the splitter blades, or TABLE 2-1 for the main blades and TABLE 2-2 for the splitter blades, or TABLE 3-1 for the main blades and TABLE 3-2 for the splitter blades; and an impeller section including a plurality of impeller main blades, a plurality of impeller primary splitter blades, and a plurality of impeller secondary splitter blades, each of which includes normal to the blade mean line cross sectional surfaces distributed over the length of the blades, the cross sectional surfaces defined as a set of cylindrical coordinates, wherein a Z-axis aligns with a rotational axis of the blades, an R coordinate corresponds to a distance from the Z axis and a theta coordinate is the relative angular position, said coordinates relative to the value D2 which corresponds to the impeller outer diameter, set out in one set of tables, TABLE 1-3 for the main blades, TABLE 1-4 for the primary splitter blades and TABLE 1-5 for the secondary splitter blades, or TABLE 2-3 for the main blades, TABLE 2-4 for the primary splitter blades and TABLE 2-5 for the secondary splitter blades, or TABLE 3-3 for the main blades, TABLE 3-4 for the primary splitter blades and TABLE 3-5 for the secondary splitter blades.

* * * * *